US011063330B2

(12) United States Patent
Shimura

(10) Patent No.: US 11,063,330 B2
(45) Date of Patent: Jul. 13, 2021

(54) FILTER

(71) Applicant: CANON KABUSHIKI KAISHA, Tokyo (JP)

(72) Inventor: Hajime Shimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/741,077

(22) Filed: Jan. 13, 2020

(65) Prior Publication Data

US 2020/0153070 A1 May 14, 2020

Related U.S. Application Data

(62) Division of application No. 15/608,383, filed on May 30, 2017.

(30) Foreign Application Priority Data

May 31, 2016 (JP) ..... 2016-109236

(51) Int. Cl.

| | |
|---|---|
| ***H01P 1/203*** | (2006.01) |
| ***H01P 1/212*** | (2006.01) |
| ***H01P 7/08*** | (2006.01) |
| ***H01Q 1/38*** | (2006.01) |
| ***H01Q 15/00*** | (2006.01) |
| *H01Q 9/20* | (2006.01) |

(52) U.S. Cl.

CPC ..... *H01P 1/203* (2013.01); *H01P 1/212* (2013.01); *H01P 7/08* (2013.01); *H01Q 1/38* (2013.01); *H01Q 15/004* (2013.01); *H01Q 15/0026* (2013.01); *H01Q 9/20* (2013.01)

(58) Field of Classification Search

CPC .. H01P 1/212; H01P 7/08; H01P 1/207; H01P 1/203; H01P 1/20327

USPC ..... 333/176, 204, 205

See application file for complete search history.

(56) References Cited

U.S. PATENT DOCUMENTS

| | | | |
|---|---|---|---|
| 9,583,818 | B2 | 2/2017 | Shimura |
| 10,128,552 | B2 | 11/2018 | Morita et al. |
| 2008/0117004 | A1 | 5/2008 | Mochizuki |

(Continued)

FOREIGN PATENT DOCUMENTS

| | | | |
|---|---|---|---|
| JP | H03198402 | | 8/1991 |
| JP | H05335803 | A | 12/1993 |

(Continued)

OTHER PUBLICATIONS

Notice of Reasons for Refusal issued by the Japanese Patent Office dated Feb. 3, 2020 in corresponding Japanese Patent Application No. 2016-109236, with English translation.

*Primary Examiner* — Rakesh B Patel

(74) *Attorney, Agent, or Firm* — Carter, DeLuca & Farrell LLP

(57) ABSTRACT

A filter which stops the propagation of an electromagnetic wave of a predetermined frequency band in a signal line or a power supply line is provided. This filter is a conductor connected to the signal line or the power supply line. This conductor is configured to include a linear portion. The first portion of the linear portion with an end portion connected to the signal line or the power supply line has the first width, and the second portion different from the first portion of the linear portion has the second width different from the first width.

8 Claims, 25 Drawing Sheets

(56) References Cited

U.S. PATENT DOCUMENTS

| | | | | |
|---|---|---|---|---|
| 2010/0277259 | A1 | 11/2010 | Ahn et al. | |
| 2011/0316652 | A1* | 12/2011 | Satoh | H01P 1/20345 333/204 |
| 2013/0328645 | A1 | 12/2013 | Na et al. | |
| 2016/0211563 | A1 | 7/2016 | Morita et al. | |

FOREIGN PATENT DOCUMENTS

| | | | |
|---|---|---|---|
| JP | 2004056441 | A | 2/2004 |
| JP | 2008022543 | A | 1/2008 |
| JP | 2008131342 | A | 6/2008 |
| JP | 2009239559 | A | 10/2009 |
| JP | 2015002365 | A | 1/2015 |

* cited by examiner

FILTER

CROSS REFERENCE TO RELATED APPLICATIONS

This application is a divisional of U.S. patent application Ser. No. 15/608,383, filed on May 30, 2017, which claims the benefit of and priority to Japanese Patent Application No. 2016-109236 filed on May 31, 2016, each of which is hereby incorporated by reference herein in their entirety.

BACKGROUND OF THE INVENTION

Field of the Invention

The present invention relates to a filter structure.

Description of the Related Art

In general, a plurality of transmission lines are wired to a circuit substrate mounted in an electronic device, noise generated in and propagated from a circuit may be mixed in the transmission lines, and the noise may further propagate through the transmission lines. It is considered that such propagation of the noise influences the operation of the electronic device. In addition, another electronic device or the like may be influenced by noise emitted from an electronic circuit substrate due to such noise. Further, such noise may be generated in a plurality of frequency bands. To cope with this, it is considered that a filter is mounted in the transmission lines on the electronic circuit substrate in order to stop the propagation of an undesired electromagnetic wave such as the above-described noise. The above-described filter needs to have the characteristic of allowing a signal in a desired frequency band to pass through and having stop bands in a plurality of frequency bands. Various structures are proposed (see Japanese Patent Laid-Open Nos. 2008-022543, 2008-131342, and 2004-056411) for a band-stop filter which stops the propagation of an electromagnetic wave in a specific frequency band.

In general, the electronic device needs to be smaller in size, so does the electric circuit substrate of the electronic device. In addition, parts, a circuit pattern, and the like mounted on the electric circuit substrate also need to be smaller in size. However, a filter structure with a plurality of stop bands does not achieve a satisfactory size enough to implement a compact electric circuit substrate yet.

The present invention reduces the size of the filter structure with the plurality of stop bands.

SUMMARY OF THE INVENTION

According to one aspect of the present invention, there is provided a filter which stops propagation of an electromagnetic wave of a predetermined frequency band in one of a signal line and a power supply line, the filter comprising: a conductor connected to the one of the signal line and the power supply line, and configured to include a linear portion, a first portion of the linear portion with an end portion connected to the one of the signal line and the power supply line having a first width, and a second portion different from the first portion of the linear portion having a second width different from the first width.

According to another aspect of the present invention, there is provided a filter which stops propagation of an electromagnetic wave of a predetermined frequency band in one of a signal line and a power supply line, the filter comprising: a first resonance conductor configured to resonate in a plurality of frequency bands connected or coupled to a first position of the one of the signal line and the power supply line; and a second resonance conductor configured to resonate with a first frequency band out of the plurality of frequency bands, and connected or coupled to a second position away from the first position by a length corresponding to an electrical length when an electromagnetic wave of the first frequency band propagates through the one of the signal line and the power supply line.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

Figure 1A:
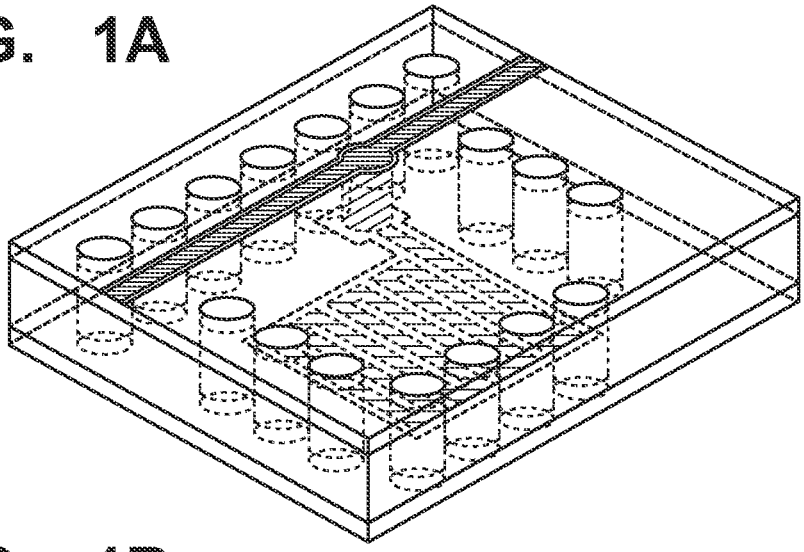
FIGS. 1A to 1C are views and a graph showing an example of the arrangement and characteristic of a band-stop filter according to the first embodiment.

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Examples of transmission lines used in an electronic circuit substrate include a microstrip line, a strip line, a slot line, a coplanar line, a coplanar strip line, a suspended microstrip line, and an inverted microstrip line. In the electronic circuit substrate, an electrical signal in a predetermined frequency band propagates through such transmission lines, implementing a predetermined process implemented in an electronic circuit.

On the other hand, noise generated from an electronic component, noise generated in another electronic circuit substrate and mixed via an interface, or an undesired electromagnetic wave such as a harmonic or the like may propagate through these transmission lines wired onto the electronic circuit substrate. It is considered that such noise influences the operation of an electronic device. In addition, another electronic device or the like may be influenced by noise emitted from the electronic circuit substrate due to such noise. Therefore, the presence of a filter which stops the propagation of such noise is important.

Note that the transmission lines can be used to propagate an electrical signal at a predetermined frequency used to process the electronic circuit, as described above. On the other hand, undesired electromagnetic waves such as noise may not unevenly be distributed only in a single frequency band but may exist widely in a plurality of frequency bands. Accordingly, the electromagnetic wave (electrical signal) in the frequency band to be allowed through and the plurality of electromagnetic waves (the undesired electromagnetic waves and noise) in the frequency bands to be stopped may coexist in the transmission lines. Therefore, the filter is required to allow the electromagnetic wave in the frequency band of the electrical signal to pass through while minimizing its attenuation and to stop the propagation of the plurality of undesired electromagnetic waves as much as possible.

Note that the filter mounted on the electronic circuit substrate can be implemented by a chip part. In particular, however, a filter of a high-frequency electromagnetic wave can also be formed by a conductor pattern. The filter formed by the conductor pattern can advantageously be implemented at a lower cost than the filter of the chip part. Further, although a mounting failure may occur in a step of mounting a part on a substrate for the filter of the chip part, this does not occur for the filter formed by the conductor pattern, leading an improvement in quality. It may be possible to further reduce a signal loss and signal attenuation in the filter formed by the conductor pattern than mounting the chip part.

Therefore, in each embodiment below, focusing on a filter having a function of attenuating specific electromagnetic waves at a plurality of frequencies and formed by a conductor pattern, a plurality of arrangement examples of such a filter will be described. Note that a transmission line here is a conductor-backed coplanar line (to be referred to as a coplanar line hereinafter), and the filter and the transmission line are mounted on a general electronic circuit substrate formed by a plurality of layers. However, a line other than the coplanar line as described above may be used for the transmission line.

First Embodiment

Figure 1B:
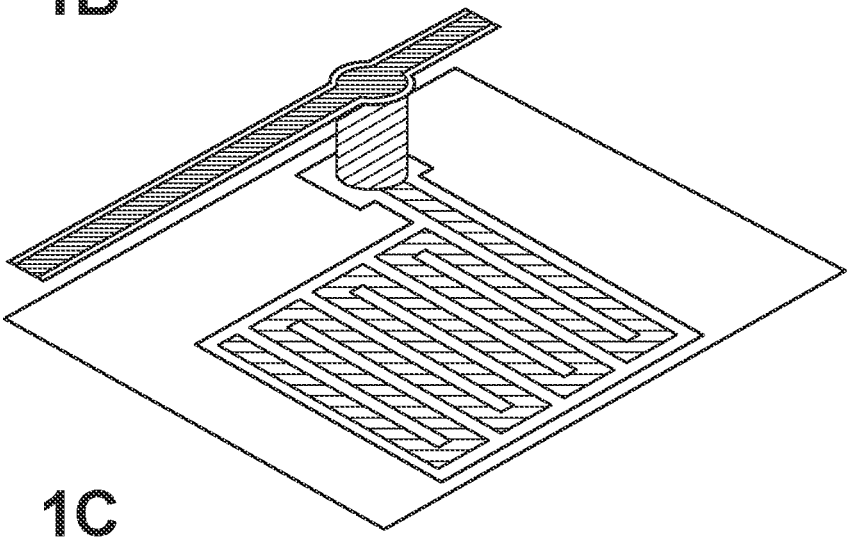

First, an example of a band-stop filter will be described with reference to FIGS. 1A to 1C. FIG. 1A shows an example of the arrangement of the band-stop filter. FIG. 1B is a view obtained by extracting only the main part of the band-stop filter in order to help understand the structure in FIG. 1A. As shown in FIGS. 1A and 1B, the band-stop filter is implemented by connecting a conductor via to a signal line of the coplanar line and forming a meander-shaped conductor connected to the via in a lower layer of a layer where the signal line is arranged.

For example, in this arrangement, a transmission line is arranged in the first layer of a four-layered structure, and the meander-shaped conductor is formed in the third layer, as shown in FIG. 1A. At this time, not only the signal line but also ground conductors may be arranged in the first layer. For example, if the transmission line formed in the first layer is the coplanar line, the signal line and the ground conductors are formed such that the signal line is sandwiched by the ground conductors at a predetermined distance. Further, not only the meander-shaped conductor but also a ground conductor can be arranged in the third layer. At this time, for example, the meander-shaped conductor and the ground conductor are formed such that the meander-shaped conductor is surrounded by the ground conductor at a predetermined distance. Note that for example, planar ground conductors each having a large area can be arranged in the second and fourth layers of the four-layered structure. At this time, these ground conductors are formed so as not to be set in a connected state with, for example, the conductor via which connects the signal line and the meander-shaped conductor shown in FIGS. 1A and 1B. Note that the ground conductors formed in the respective layers can be connected with the (large number of) conductor vias as shown in FIG. 1A in order to achieve the same ground potential in each and every layer. Note that also in each embodiment below, even not shown in the drawings, ground conductors are arranged in a plurality of layers, and they are connected with conductor vias among the layers unless otherwise specified.

FIG. 1B shows the structure obtained by removing, from the structure of FIG. 1A, the ground conductors in the first, second, and fourth layers and further removing the conductor vias which connect the ground conductors. Note that in FIG. 1B, a planar conductor arranged so as to surround the meander-shaped conductor is the ground conductor formed in the third layer. As seen in FIGS. 1A and 1B, the meander-shaped conductor is formed to be sandwiched by the ground conductors (each having the large area) of the second and fourth layers, and further surrounded by the ground conductor in the third layer where the meander-shaped conductor is arranged. In the arrangement of FIG. 1A, the ground conductor of the second layer sandwiched between the signal line and the meander-shaped conductor is configured to eliminate electromagnetic coupling between the signal line and the meander-shaped conductor.

This meander-shaped conductor is a linear conductor which has the same line width, one end portion connected to the via, and the other end portion that is an open end electrically connected to nothing. It is possible, by having a meander shape, to reduce the entire size of a structure to be mountable even on a small substrate.

Figure 1C:
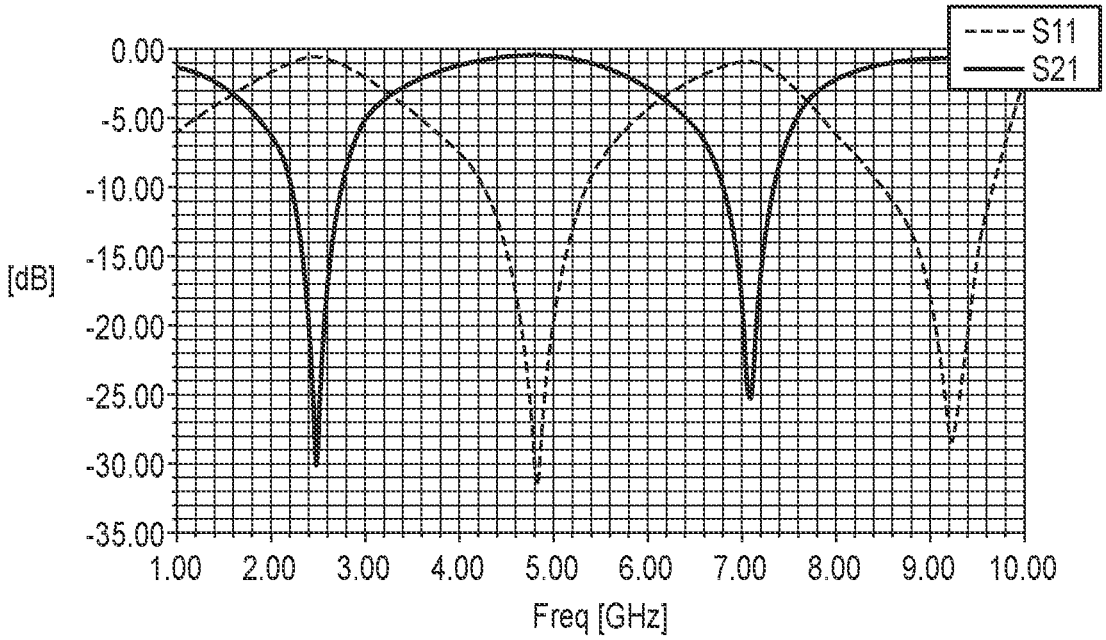

FIG. 1C shows a simulation result of a reflectance coefficient S11 and a transmission coefficient S21 at input/output ends (Port1 and Port2) of the coplanar line in which the band-stop filter as in FIGS. 1A and 1B is mounted. As seen in FIG. 1C, large attenuation is found in the curve of the transmission coefficient S21 at a frequency near 2.45 GHz, and the propagation of an electromagnetic wave near 2.45 GHz is stopped. In addition, it can be seen that large attenuation is also found in the curve of the transmission coefficient S21 near 7.1 GHz which is about triple 2.45 GHz, and the propagation of an electromagnetic wave near 7.1 GHz is also stopped. This is because the meander-shaped conductor and the via connected to the coplanar line resonate at a specific frequency. A conductor portion (that is, the meander-shaped conductor) connected to the via will be referred to as a stub, and a conductor that combines the via and the stub will be referred to as a resonance conductor hereinafter. Note that the vias for connecting the ground conductors with each other are arranged around the stub, as shown in FIG. 1A. This allows the resonance frequency of the resonance conductor to be less susceptible to a substrate shape, a substrate circuit, a part mounted on the substrate, and the like.

In the resonance conductor, whose one end portion is connected to the signal line and whose other end portion has the open end as described above, resonance occurs in a frequency band of an electrical length λ quadruple to the total length of the resonance conductor, making it possible to stop propagation in a transmission line of an electromagnetic wave at that frequency. That is, in order to stop the propagation of the electromagnetic wave in a certain frequency band with the electrical length λ, the resonance conductor is designed so as to have a total length of λ/4. Similarly, the electromagnetic wave in the frequency band with the electrical length λ can also resonate in a resonance conductor having a total length of 3λ/4 and be stopped. That is, a resonance conductor having a total length of L can stop the propagation of an electromagnetic wave having an electrical length of 4L and an electromagnetic wave having an electrical length of 4L/3. In the structure of FIGS. 1A and 1B, the total length of the resonance conductor is a quarter of the electrical length λ of about 2.45 GHz and three quarters of the electrical length λ of about 7.1 GHz, stopping the propagation of the electromagnetic wave near 2.45 GHz and the electromagnetic wave near 7.1 GHz.

Letting f1 (2.45 GHz in this embodiment) be a frequency band serving as the first stop band and f2 (7.1 GHz in this embodiment) be a frequency band serving as the second stop band, the relation of $f2 \cong 3 \times f1$ holds when the meander-shaped conductor has the same line width as in FIG. 1.

In the structure as in FIGS. 1A and 1B described above, it is possible, by adjusting the length of the meander-shaped conductor, to set one of f1 and f2 to be at a desired frequency (a frequency to be a stop band). However, if there are a plurality of frequency bands to be stopped, the relation between f1 and f2 is $f2 \cong 3 \times f1$, as described above. Thus, if the relation between the plurality of frequency bands to be stopped is a relation other than the above-described relation, a plurality of desired frequency bands cannot be stopped with the structure of FIGS. 1A and 1B.

Figure 2A:
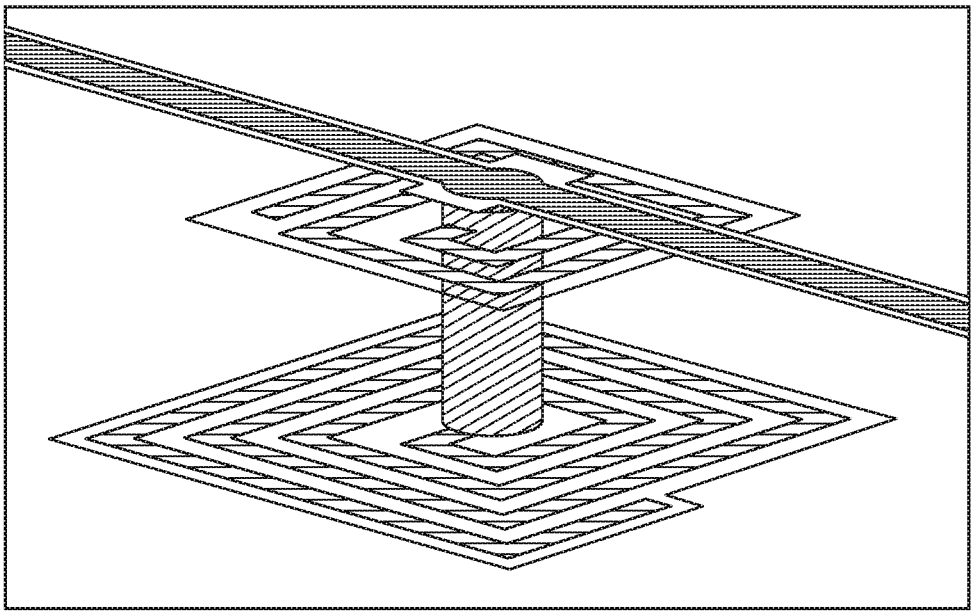
FIGS. 2A and 2B are a view and a graph showing an example of the arrangement and characteristic of the band-stop filter according to the first embodiment.
Figure 2B:
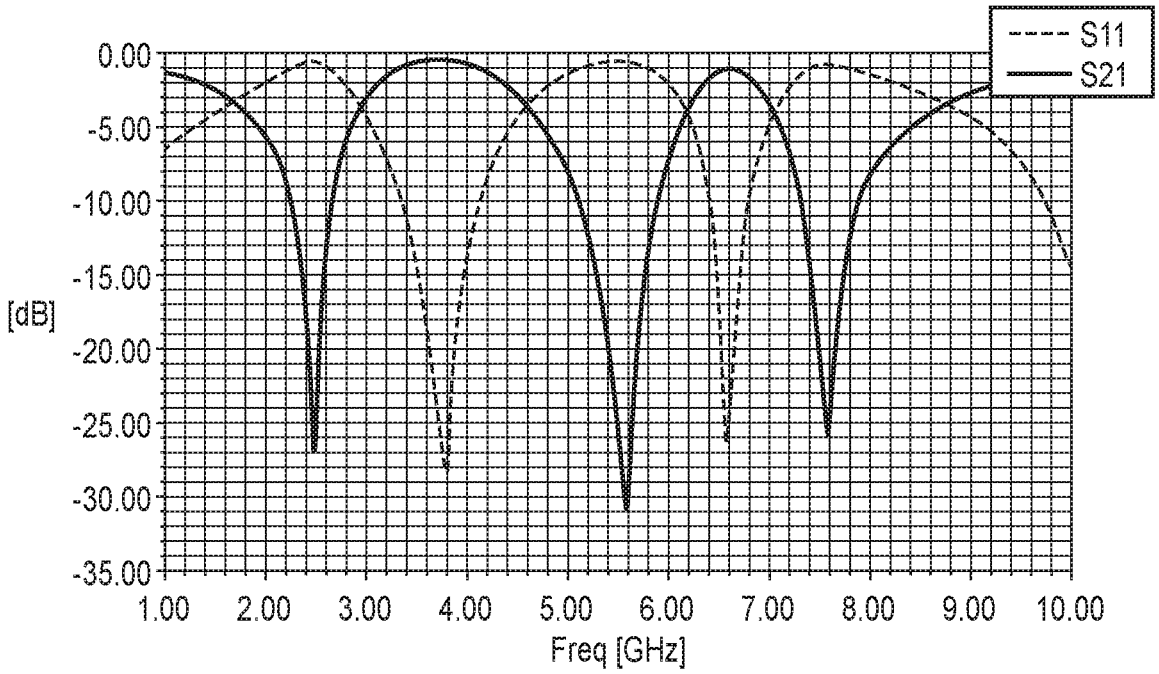

The arrangement of a band-stop filter which stops the propagation of electromagnetic waves in the plurality of desired frequency bands will now be described. FIG. 2A shows an example of the arrangement of a band-stop filter which stops the plurality of desired frequency bands. FIG. 2B shows the characteristic of the band-stop filter in FIG. 2A. In the band-stop filter of FIG. 2A, a via is connected to a signal line of a coplanar line, and a spiral-shaped stub (stub 1) connected to the via is arranged in a lower layer of a layer where the signal line is arranged. In this band-stop filter, a stub (stub 2) connected to the via is also arranged in a further lower layer of the layer where the stub 1 is arranged. For example, the coplanar line can be formed in the first layer of a four-layered substrate, and the stub 1 and the stub 2 can be formed in the second layer and the third layer or the third layer and the fourth layer, respectively. Note that the stub 1 has the same line width, and the stub 2 also has the same line width. In the arrangement of FIG. 2A, each length of the stub 1 and the stub 2 is adjusted in accordance with, for example, a frequency band that stops propagation. Note that a 2.45-GHz band and a 5.5-GHz band serve as frequency bands that stop propagation.

FIG. 2B shows a simulation result of the reflectance coefficient S11 and the transmission coefficient S21 at the input/output ends (Port1 and Port2) of the coplanar line in which the band-stop filter is mounted as in FIG. 2A. As seen in FIG. 2B, the stop bands are formed in the 2.45-GHz band and the 5.5-GHz band, and the stop bands can be formed in the plurality of desired frequency bands by the structure of FIG. 2A.

In general, it is possible, by connecting a plurality of resonance conductors each having a predetermined length to the signal line, to form the stop bands in the plurality of desired frequency bands. For example, it is possible to form the stop bands in two frequency bands by connecting two resonance conductors to two portions on the signal line and making the total length of each resonance conductor be a quarter of the electrical length λ of a corresponding one of frequencies. In general, however, a loss occurs in a signal which propagates onto a transmission line if a discontinuous part such as a via exists in the transmission line. If a plurality of connecting portions exist on the signal line, a plurality of discontinuous parts may exist on the signal line, greatly degrading the transmission characteristic of the signal line. That is, in addition to stopping an undesired electromagnetic wave, that may cause degradation in signal quality of an electromagnetic wave in a frequency band at which to transmit (to be allowed to pass through). Further, if an arrangement includes a plurality of filter structures, it may become difficult to reduce the size of an electronic circuit.

To cope with this, FIG. 2A adopts a structure in which a plurality of stubs branch off from one via connected to the signal line so as to minimize the number of connection points to the signal line of a resonance conductor connected to the signal line. This makes it possible to suppress the degradation in signal quality because the discontinuous parts of the signal line are decreased. Further, as in FIG. 2A, the respective stubs are arranged so as to overlap each other when viewed from a direction perpendicular to a substrate plane, allowing the filter to have a smaller mounting area and be mounted on a small substrate. Furthermore, it is also possible to reduce the size of the filter by sharing the via. As described above, it is possible, by connecting the plurality of stubs to one via connected to the signal line, to form a small filter which forms the stop bands in the plurality of desired frequency bands while suppressing the degradation in signal quality.

Second Embodiment

In the first embodiment, the arrangement has been described in which the plurality of stubs each having a length corresponding to the frequency band of a corresponding one of stop bands in order to obtain a plurality of desired stop bands are connected to the via connected to the signal line. In contrast, in this embodiment, a filter arrangement will be described in which a plurality of desired stop bands are implemented while arranging a stub connected to a via in one layer.

As has been described in the first embodiment, letting f1 be the frequency band serving as the first stop band and f2 be the frequency band serving as the second stop band when the meander-shaped stub in FIG. 1A has the same line width, the relation of f2≅3×f1 holds, and the stop bands can be set only under this relation. In contrast, in this embodiment, a filter arrangement will be described in which a first stop band f1 and a second stop band f2 can be set arbitrarily while being formed in one layer by adjusting the line width of the stub connected to the via.

Each of FIGS. 3A to 3J shows an example of the arrangement of a band-stop filter according to this embodiment. FIGS. 3A to 3E are views each showing the arrangement of the filter. Each of FIGS. 3F to 3J shows a simulation result of a reflectance coefficient S11 and a transmission coefficient S21 at input/output ends (Port1 and Port2) of a coplanar line in which the band-stop filter in FIGS. 3A to 3E is mounted.

In the band-stop filter of each of FIGS. 3A to 3E, a via is connected to the signal line of the coplanar line, and a meander-shaped stub connected to the via is arranged in a lower layer of a layer where the signal line is arranged. Further, in the band-stop filter of each of FIGS. 3A to 3E, the stub has two different line widths, and a portion of the stub including an open end has a thicker line width than a portion of the stub including a connection point to the via. FIGS. 3A to 3E are different in length ratio of a portion of the stub having a different line width. Accordingly, each of FIGS. 3F to 3J shows a characteristic change when such a ratio changes.

As is apparent from FIGS. 3F to 3J, it is found that the first stop band (the stop band on a low frequency side) is not changed greatly, but the second stop band (the stop band on a high frequency side) is changed by changing the length ratio between a portion having a thick stub line width and a portion having a thin stub line width. That is, as seen in FIGS. 3F to 3J, while the frequency band f1 serving as the first stop band is about 2.2 GHz in either case, the frequency band f2 serving as the second stop band changes between 6.9 GHz and 7.4 GHz. That is, it is found that f2>3×f1 can be obtained by making a portion of the stub including an open end have a thicker line width than the portion of the stub including the connection point to the via.

Figure 3A:
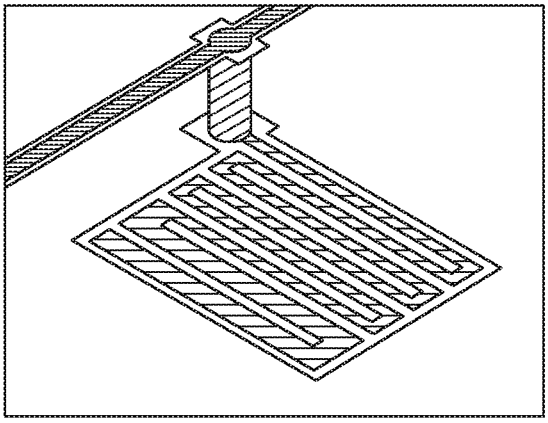
FIGS. 3A to 3J are views and graphs each showing an example of the arrangement and characteristic of a band-stop filter according to the second embodiment.
Figure 3D:
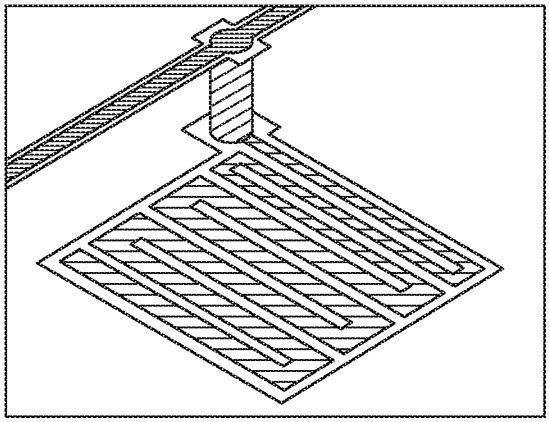
Figure 3B:
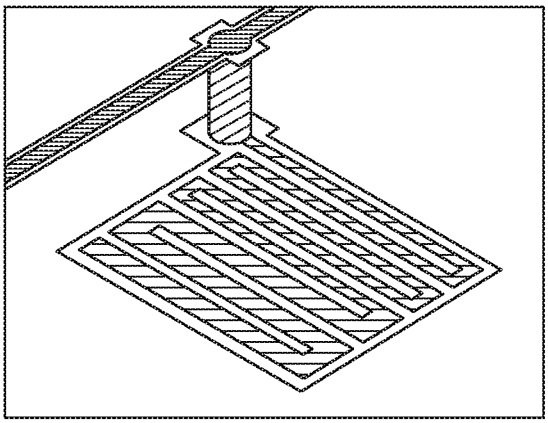
Figure 3E:
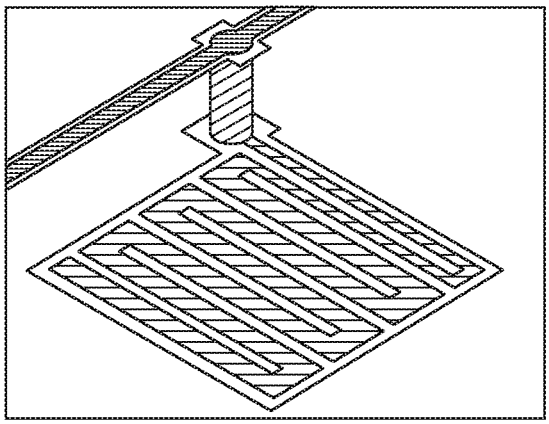
Figure 3C:
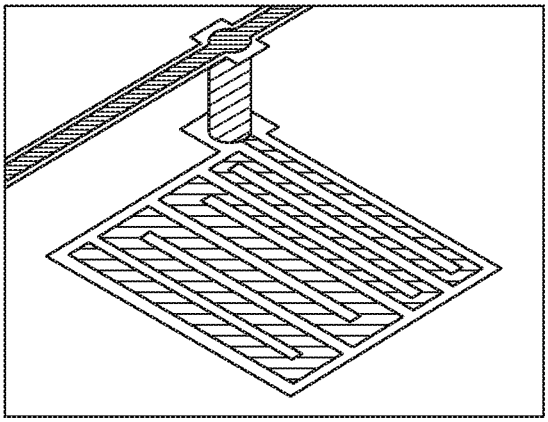
Figure 3F:
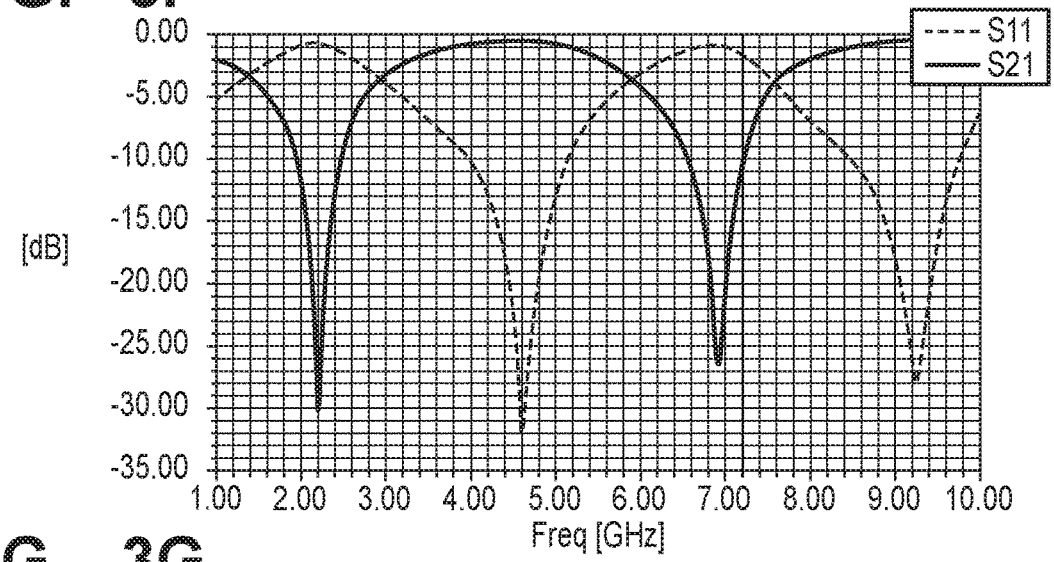
Figure 3G:
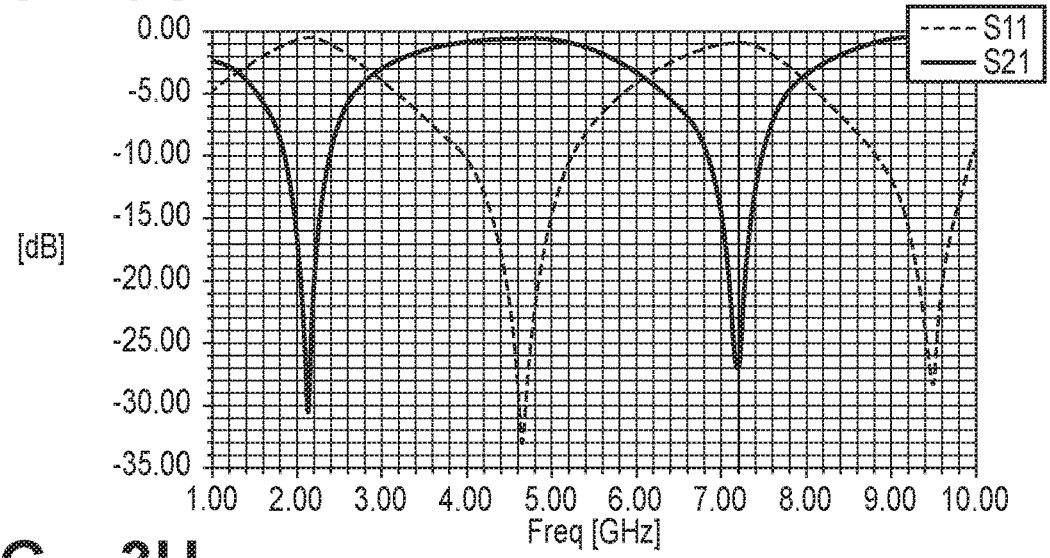
Figure 3H:
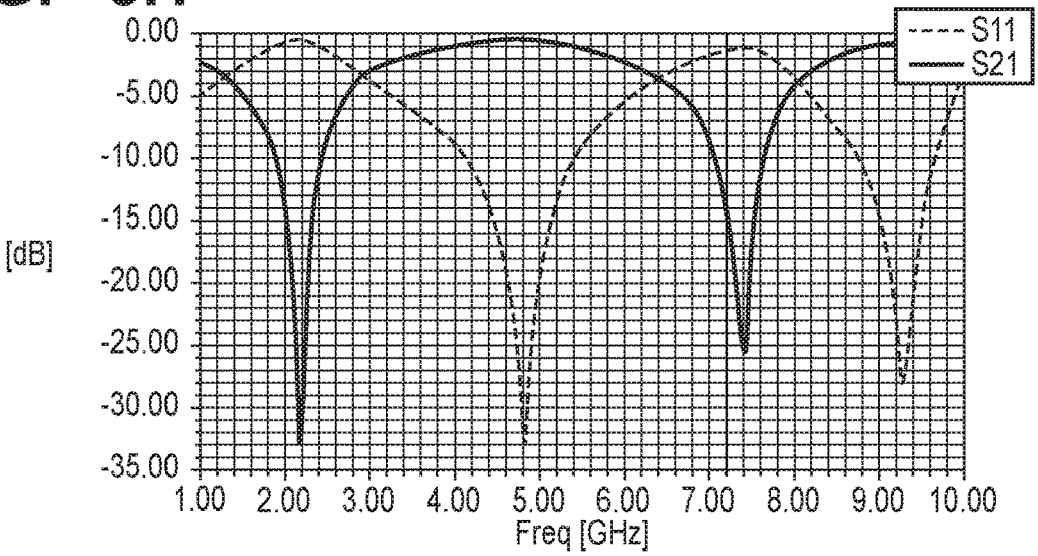
Figure 3I:
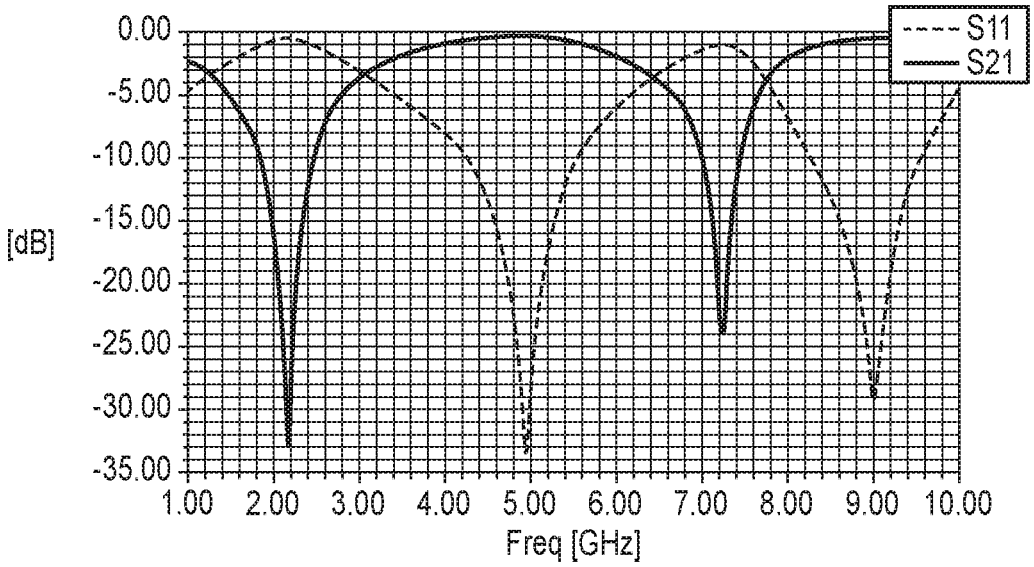
Figure 3J:
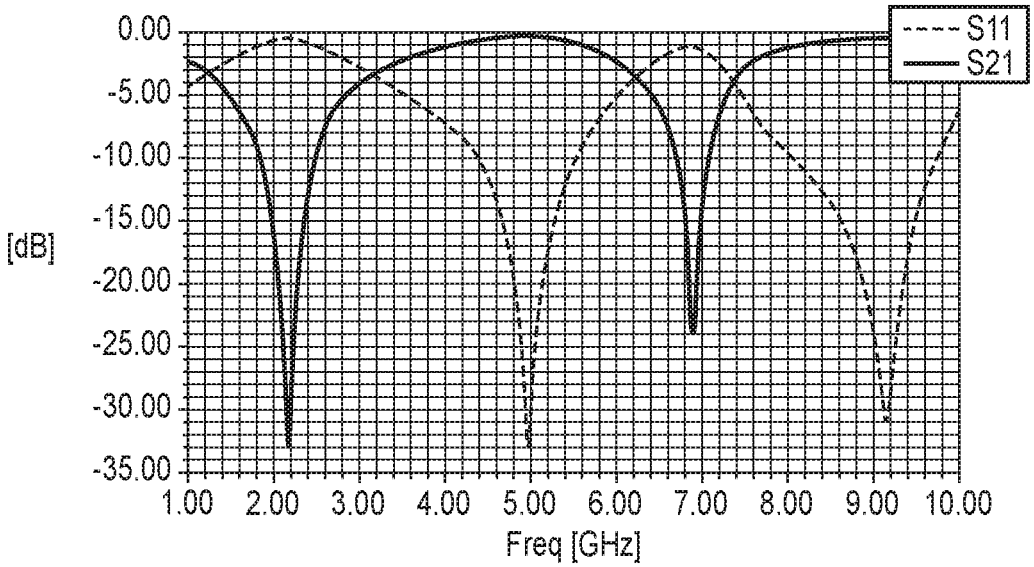

If the length ratio between the portion having the thick stub line width and the portion having the thin stub line width is almost equal as shown in FIG. 3C, the second stop band (the stop band on the high frequency side) is 7.4 GHz as shown in FIG. 3H. As compared with FIGS. 3F, 3G, 3I, and 3J, it is found that FIG. 3H includes the second stop band in the high frequency band f2 farthest from a stop band in the low frequency band f1. It is also found that the characteristics in FIGS. 3F and 3J are almost the same, and the characteristics in FIGS. 3G and 3I are almost the same. Therefore, it becomes possible, by adjusting the length ratio between the portion having the thick stub line width and the portion having the thin stub line width, to adjust the frequency band f1 serving as the first stop band and the frequency band f2 serving as the second stop band to be desired frequency bands in the range of f2>3×f1.

Figure 4A:
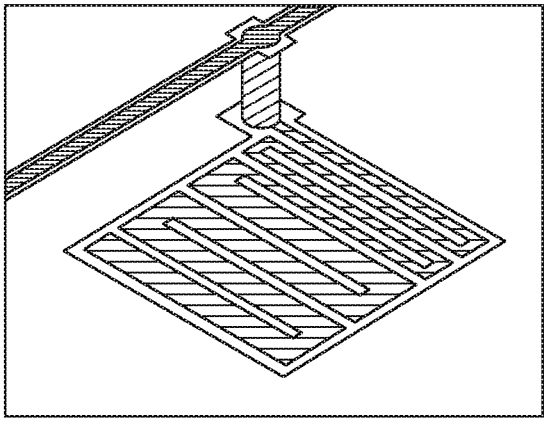
FIGS. 4A to 4F are views and graphs each showing an example of the arrangement and characteristic of the band-stop filter according to the second embodiment.
Figure 4B:
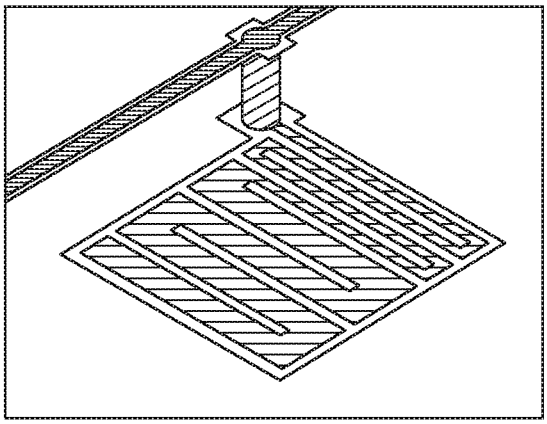
Figure 4C:
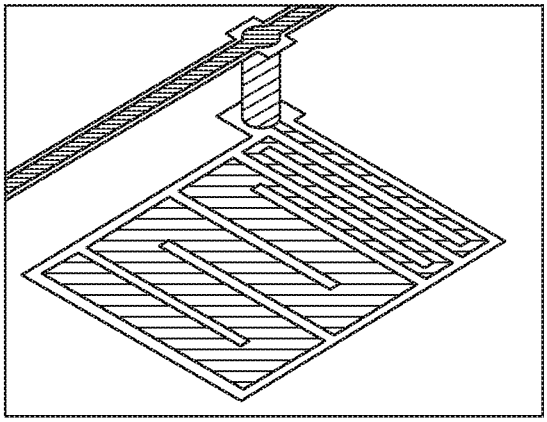
Figure 4D:
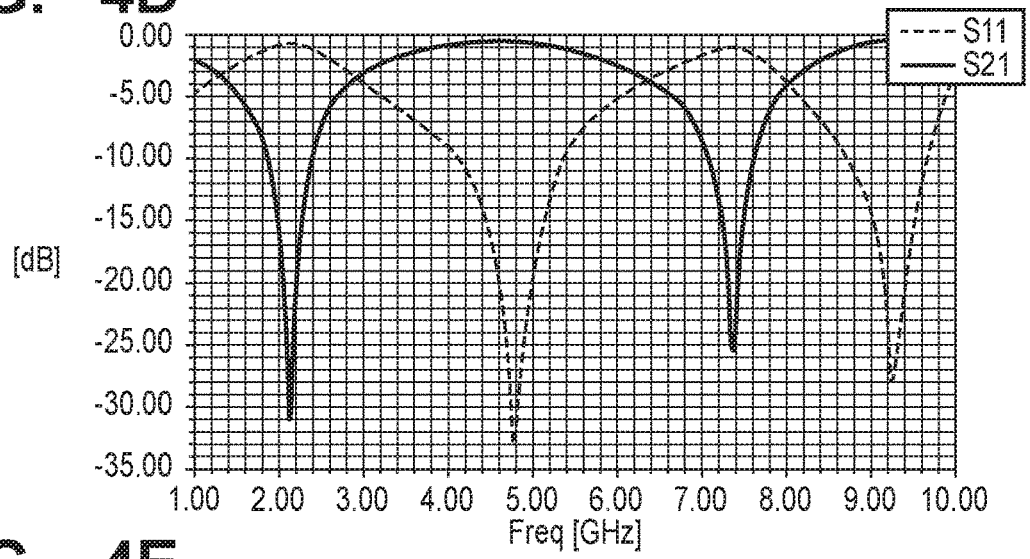
Figure 4E:
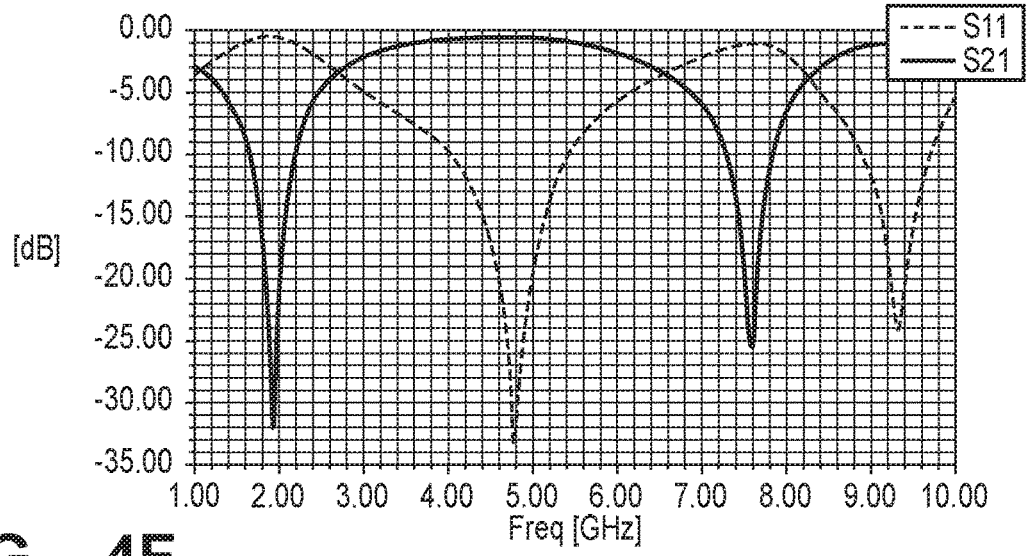
Figure 4F:
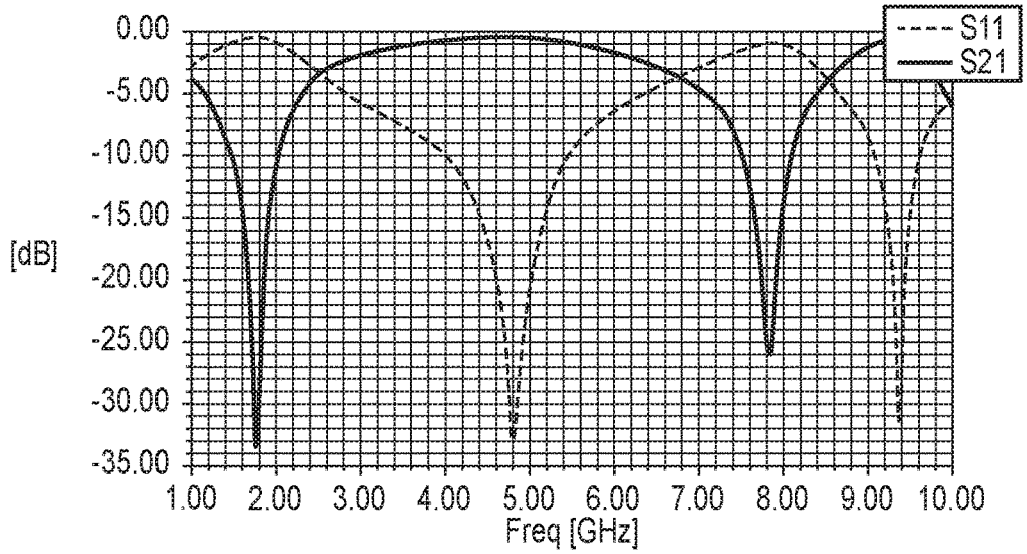

Next, each of FIGS. 4A and 4F shows a filter structure and its characteristic when the portion having the thick stub line width and the portion having the thin stub line width are generally made equal to each other in length, and a line width is changed. FIG. 4A shows the arrangement in which the line-width ratio between a thin portion and a thick portion is the closest to 1, FIG. 4C shows the arrangement in which the ratio is the farthest from 1, and FIG. 4B is the arrangement in which the ratio lies between those of FIGS. 4A and 4C. Note that FIGS. 4D to 4F show characteristics in FIGS. 4A to 4C, respectively. As seen in FIGS. 4D to 4F, as the line-width ratio is away from 1, f2 is away from f1, and a stop band shifts to a higher frequency band.

As described above, it is possible, by making the portion of the stub including the open end larger in line width than the portion other than that in the band-stop filter as in FIGS. 1A and 1B, to set the relation between the frequency band f1 serving as the first stop band and the frequency band f2 serving as the second stop band to f2>3×f1. It is also possible, by adjusting the length ratio between the portion having the thick stub line width and the portion having the thin stub line width, and the line-width ratio, to adjust the frequency bands f1 and f2 of the stop bands. Note that the characteristics of the band-stop filter structures in FIGS. 3A and 3E are almost the same and further, the characteristics of the band-stop filter structures in FIGS. 3B and 3D are almost the same, as described above. The filter can be reduced in size by narrowing the line width of a conductor in a structure. It is therefore possible to seek further downsizing of the band-stop filter in FIG. 3A having the higher ratio of a narrow line width than FIG. 3E. Similarly, it is possible to seek further downsizing of the band-stop filter in FIG. 3B having the higher ratio of a narrow line width than FIG. 3D. That is, it becomes possible, by setting the lengths of the portion having the thick stub line width and the portion having the thin stub line width to the length of the portion having the thick stub line width≤ the length of the portion having the thin stub line width, to seek the downsizing of the filter structure.

As described above, it is possible, by increasing the line width of the portion of the stub including the open end, to set the relation between the frequency band f1 serving as the first stop band and the frequency band f2 serving as the second stop band to f2>3×f1. It is also possible, by adjusting the ratio between the length of the portion having the thick stub line width and the length of the portion having the thin stub line width, and the line-width ratio, to set a desired frequency band to a stop band. At this time, it is also possible, by making the length of the portion having the thick stub line width shorter than the length of the portion having the thin stub line width, to reduce the size of the filter structure.

In this embodiment, when the band-stop filter which stops the plurality of frequency bands is formed, the band-stop filter is formed which stops the plurality of frequency bands not by connecting a plurality of resonance elements to a transmission line separately but by using a stub connected to the transmission line with one via. This makes it possible to reduce a loss of a signal propagating through the transmission line as in the first embodiment. Further, in this embodiment, the plurality of resonance elements need not be arranged, making it possible to reduce the size of an electronic circuit including the band-stop filter. Furthermore, the band-stop filter of this embodiment is configured to arrange one stub in one layer, and thus is also applicable to, for example, a substrate having the small number of layers such as a two-layered substrate.

Third Embodiment

In this embodiment, a filter arrangement will be described in which a plurality of desired stop bands are obtained while a stub connected to a via is arranged in one layer as in the second embodiment. Unlike the second embodiment, in this embodiment, it is possible, by reducing the line width of a portion of the stub including an open end, to set the relation between a frequency band f1 serving as the first stop band and a frequency band f2 serving as the second stop band to f2<3×f1.

Figure 5A:
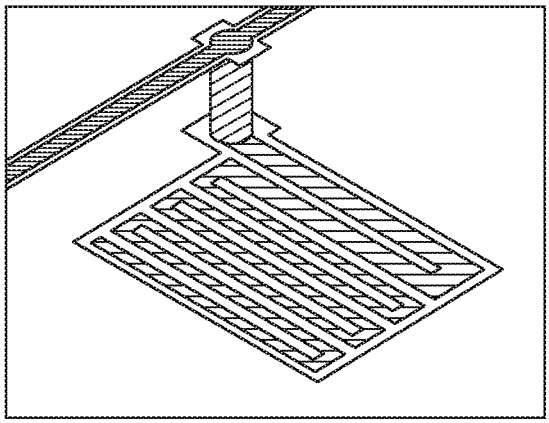
FIGS. 5A to 5J are views and graphs each showing an example of the arrangement and characteristic of a band-stop filter according to the third embodiment.
Figure 5D:
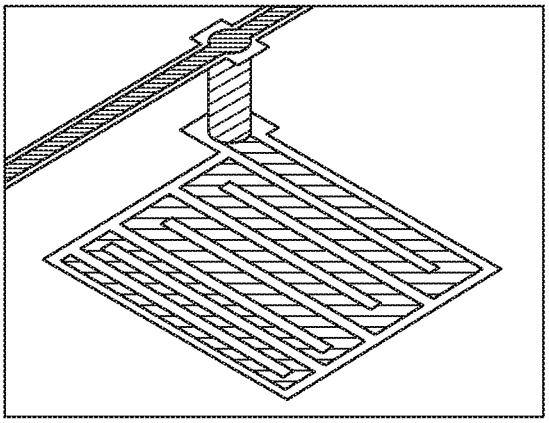
Figure 5B:
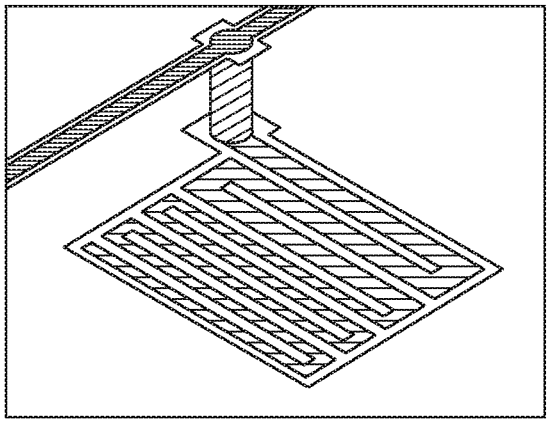
Figure 5E:
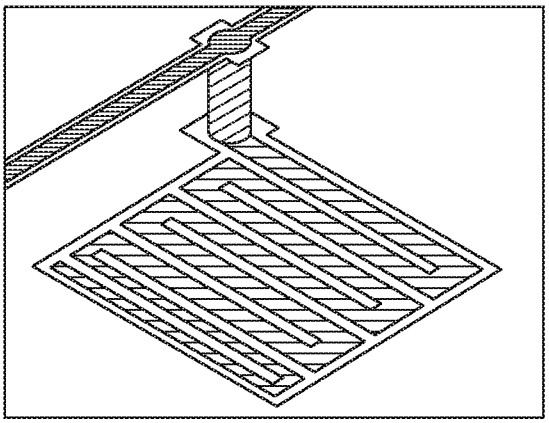
Figure 5C:
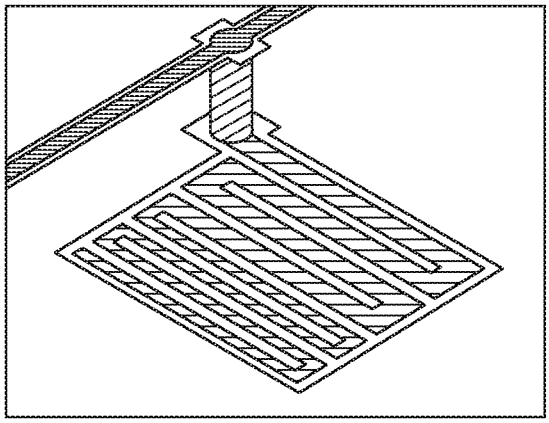
Figure 5F:
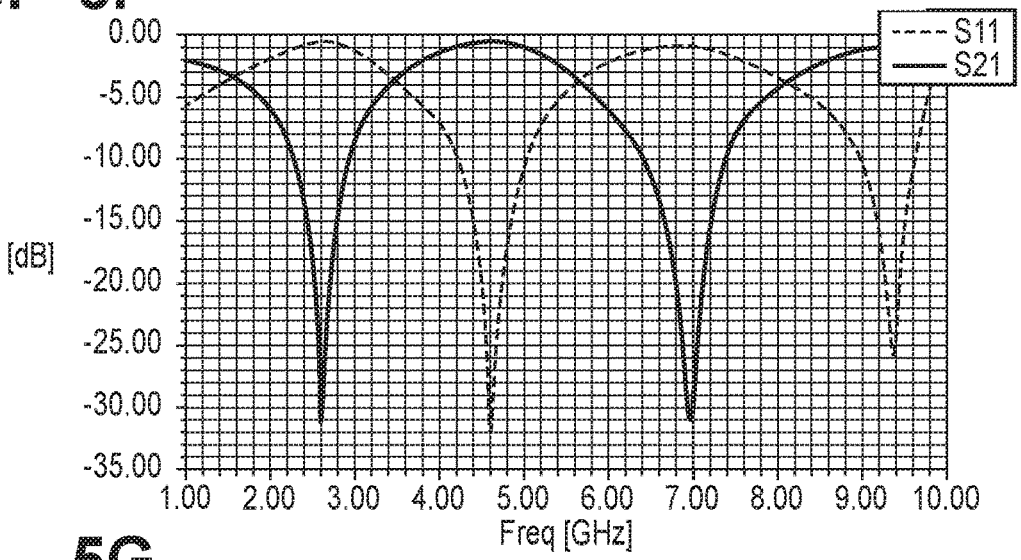
Figure 5G:
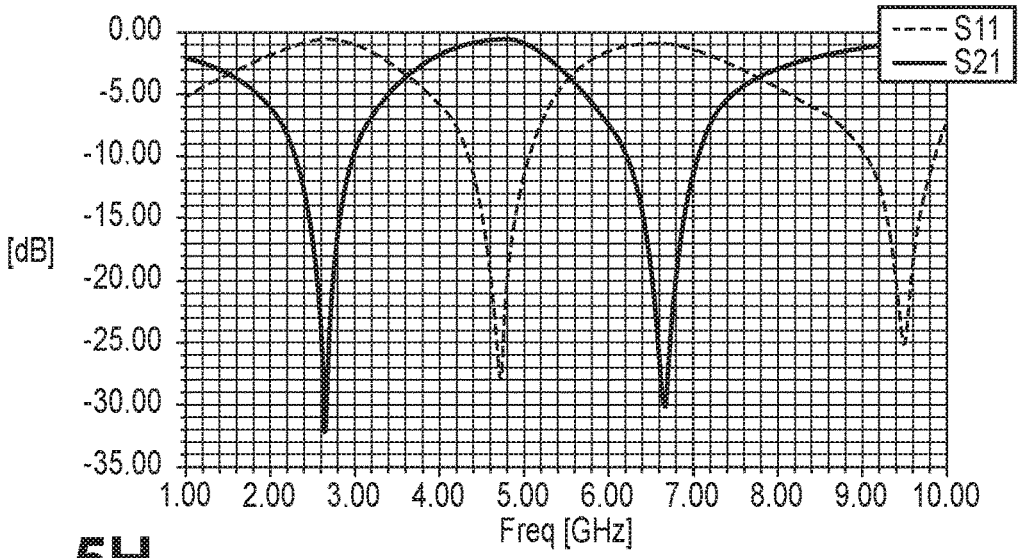
Figure 5H:
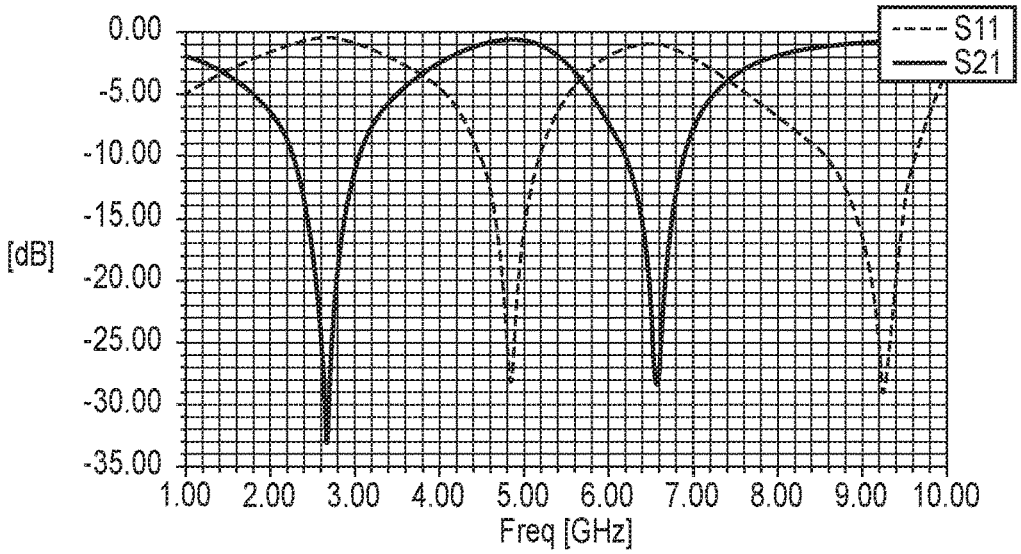
Figure 5I:
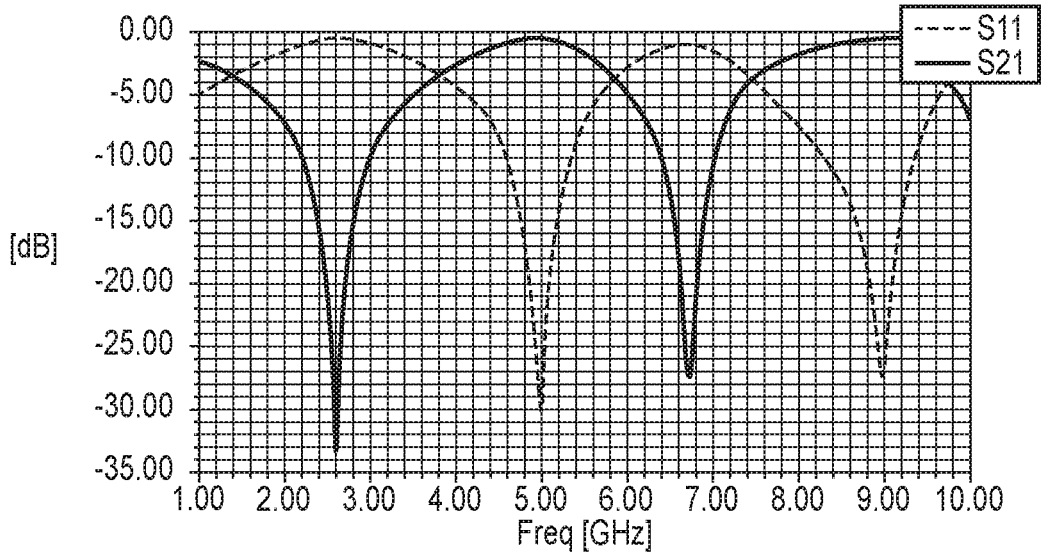
Figure 5J:
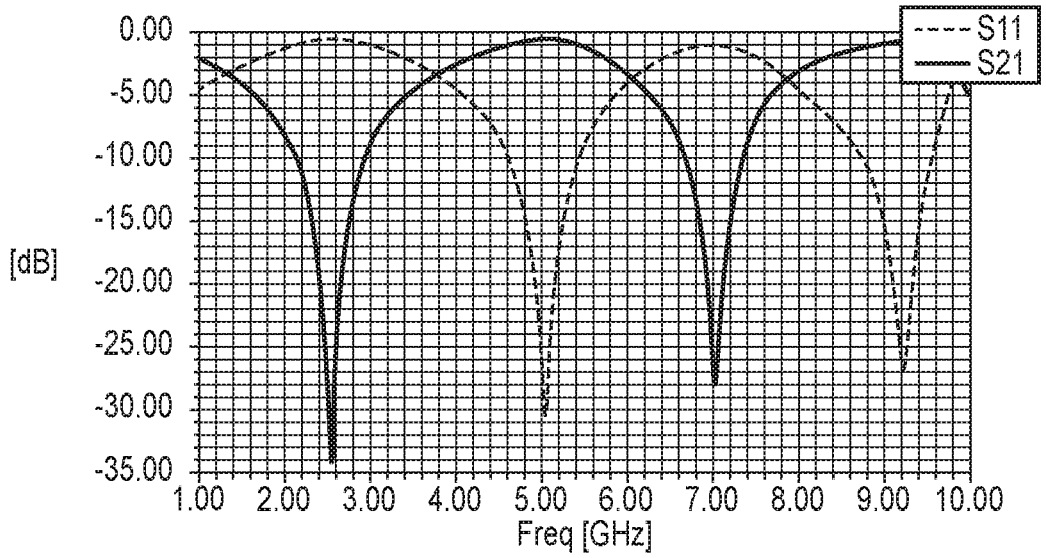

Each of FIGS. 5A to 5E shows a filter structure when the length ratio of a portion of the stub having a different line width changes. FIGS. 5F to 5J show the respective characteristics of their filter structures. From FIGS. 5F to 5J, the first stop band (the stop band on a low frequency side) is about 2.6 GHz and is not changed greatly, but the second stop band (the stop band on a high frequency side) is changed when the length ratio between a portion having a thick stub line width and a portion having a thin stub line width is changed as in FIGS. 5A to 5E. If the length ratio between the portion having the thick stub line width and the portion having the thin stub line width is almost equal as shown in FIG. 5C, the second stop band (the stop band on the high frequency side) is about 6.6 GHz. As compared with the filter structures of FIGS. 5A, 5B, 5D, and 5E, this filter structure of FIG. 5C includes the stop band of the low frequency band f2 closest to the frequency band f1 of the stop band on the low frequency side. The characteristics in FIGS. 5F and 5J are almost the same, and the characteristics in FIGS. 5G and 51 are almost the same. In any of the cases of FIGS. 5F to 5J, the relation between the frequency band f1 serving as the first stop band and the frequency band f2 serving as the second stop band is f2<3×f1.

Figure 6A:
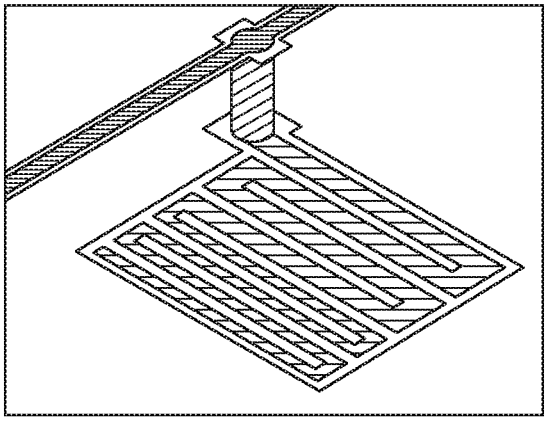
FIGS. 6A to 6F are views and graphs each showing an example of the arrangement and characteristic of the band-stop filter according to the third embodiment.
Figure 6B:
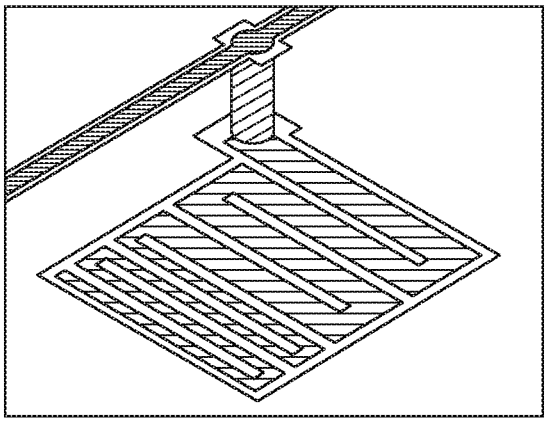
Figure 6C:
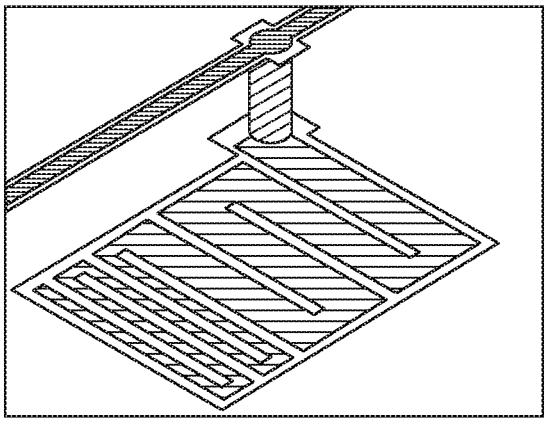
Figure 6D:
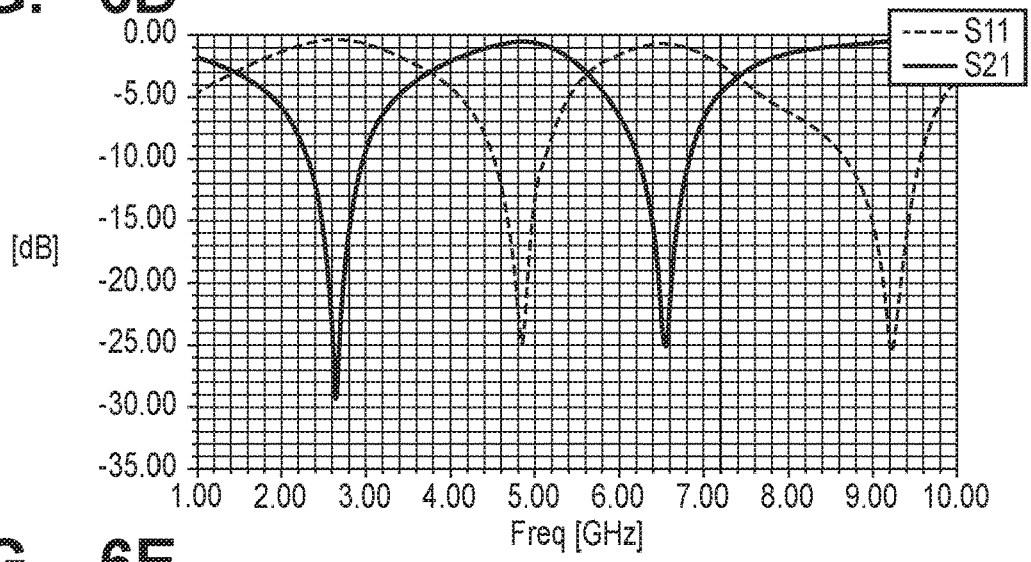
Figure 6E:
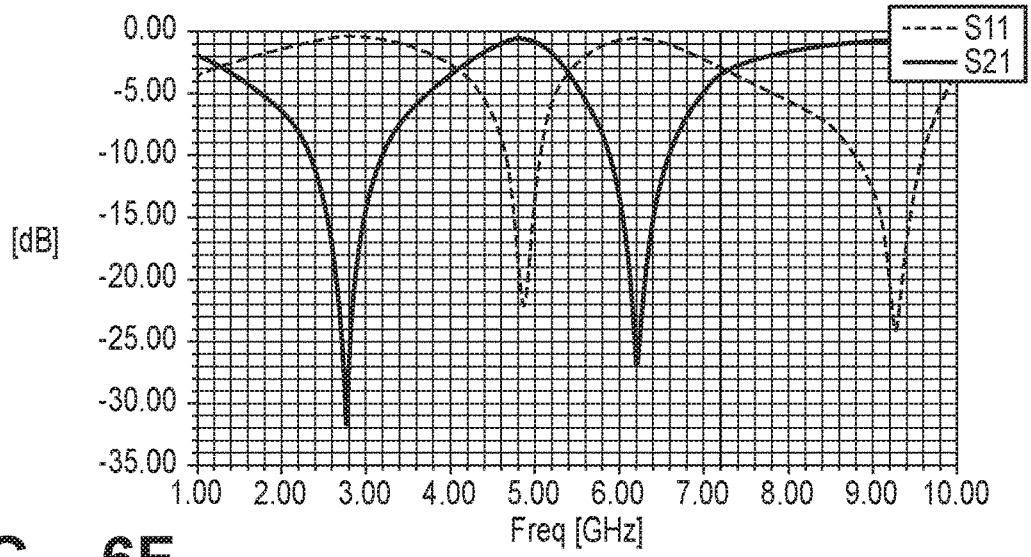
Figure 6F:
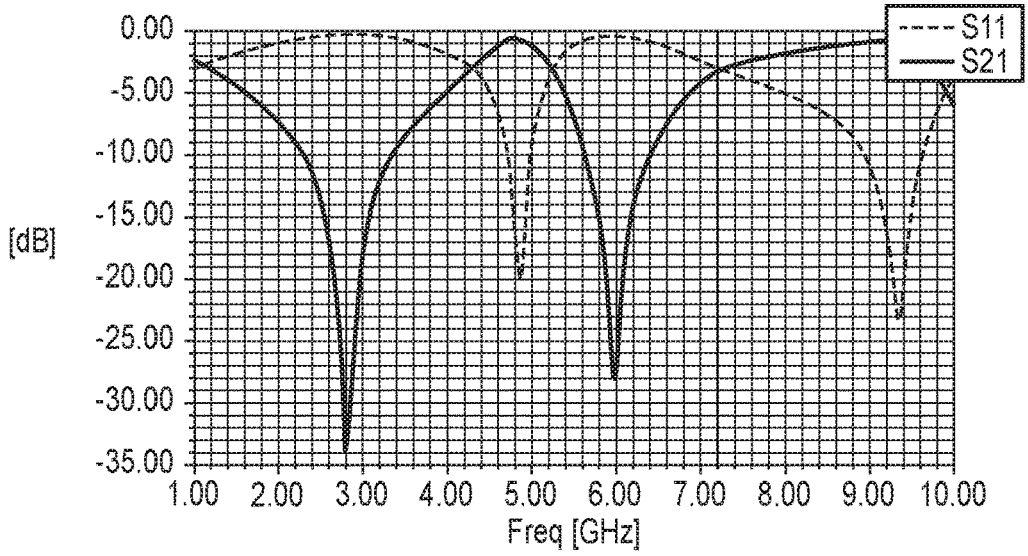

Each of FIGS. 6A to 6C shows a filter structure with a portion having a thick stub line width and a portion having a thin stub line width generally equal to each other in length, and a different line width. FIGS. 6D to 6F show the characteristics of their filter structures. As seen in FIGS. 6D to 6F, as the line-width ratio is away from 1 (the line-width difference between a thick portion and a thin portion is larger), out of the stop bands, the higher frequency band f2 becomes closer to the lower frequency band f1 and shifts to a lower frequency side.

As described above, it is possible, by making the portion of the stub including the open end smaller in line width than the portion other than that in the band-stop filter as in FIGS. 1A and 1B, to set the relation between the frequency band f1 serving as the first stop band and the frequency band f2 serving as the second stop band to f2<3×f1. It is also possible, by adjusting the lengths of the portion having the thick stub line width and the portion having the thin stub line width, and the line-width ratio, to set a desired frequency band to a stop band. Note that as described above, the characteristics in FIGS. 5F and 5J are almost the same, and the characteristics in FIGS. 5G and 51 are almost the same. Accordingly, as in the second embodiment, it is possible, by making the length of the portion having the thick stub line width shorter than the length of the portion having the thin stub line width, to reduce the size of the filter structure. It is therefore possible to seek further downsizing of the band-stop filter in FIG. 5A having the higher ratio of a narrow line width than FIG. 5E. Similarly, it is possible to seek further downsizing of the band-stop filter in FIG. 5B having the higher ratio of a narrow line width than FIG. 5D. That is, it becomes possible, by setting the lengths of the portion having the thick stub line width and the portion having the thin stub line width to the length of the portion having the thick stub line width≤the length of the portion having the thin stub line width, to seek the downsizing of the filter structure.

As described above, it is possible, by reducing the line width of the portion of the stub including the open end, to set the relation between the frequency band f1 serving as the first stop band and the frequency band f2 serving as the second stop band to f2<3×f1. It is also possible, by adjusting the ratio between the length of the portion having the thick stub line width and the length of the portion having the thin stub line width, and the line-width ratio, to set a desired frequency band to a stop band. At this time, it is also possible, by making the length of the portion having the thick stub line width shorter than the length of the portion having the thin stub line width, to reduce the size of the filter structure.

As also seen in FIGS. 4A to 4F according to the second embodiment and FIGS. 6A to 6F according to this embodiment, as an area occupied by the stub line width is larger, large attenuation is obtained in a transmission coefficient S21. That is, FIG. 4C out of FIGS. 4A to 4C and FIG. 6C out of FIGS. 6A to 6C obtain the largest attenuation in the transmission coefficient S21. Therefore, it becomes possible to form a filter having a desired characteristic by determining the stub line width at the time of design so as to obtain a desired transmission characteristic (attenuation characteristic).

In this embodiment, when the band-stop filter which stops the plurality of frequency bands is formed, the band-stop filter is formed which stops the plurality of frequency bands by using a stub connected to the transmission line with one via, as in the first and second embodiments. This makes it possible to reduce a loss of a signal propagating through the transmission line, as in the first and second embodiments. Further, in this embodiment, a plurality of resonance elements need not be arranged, making it possible to reduce the size of an electronic circuit including the band-stop filter. Furthermore, the band-stop filter of this embodiment is configured to arrange one stub in one layer, and thus is also applicable to, for example, a substrate having the small number of layers such as a two-layered substrate, as in the second embodiment.

Fourth Embodiment

In each filter structure of the first to third embodiments, the ground conductor is arranged so as to surround the stub in the layer where the stub is arranged. Further, in each filter structure of the first to third embodiments, the ground conductors are also arranged in the upper and lower layers facing the layer where the stub is arranged, and the stub is arranged to be sandwiched between the ground conductors. That is, in each filter structure of the first to third embodiments, the stub is surrounded by the ground conductor.

Figure 8:
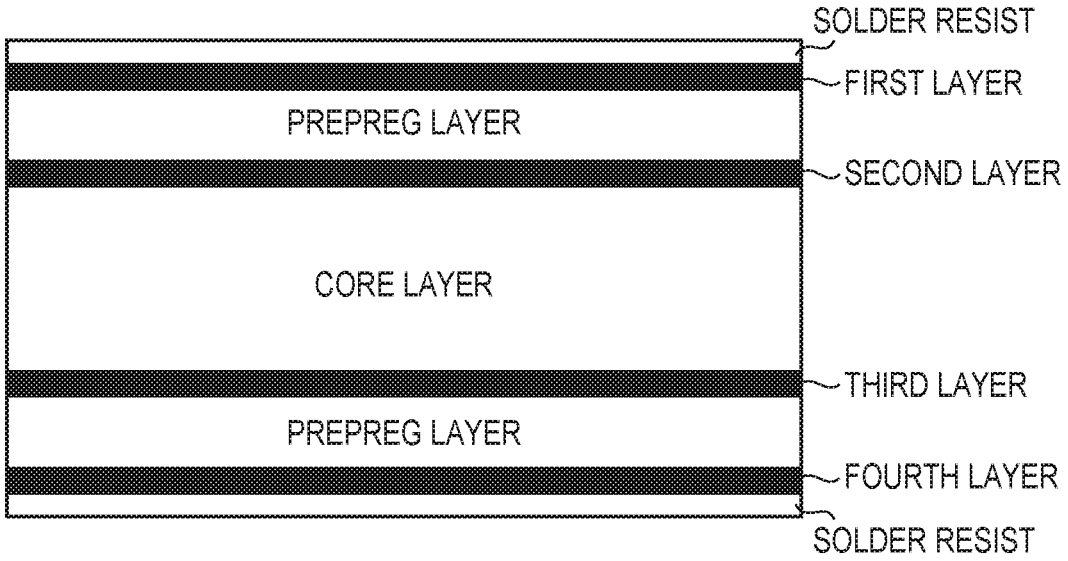
FIG. 8 is a sectional view showing a substrate where the band-stop filter is formed.

The effect of this ground conductor will be described below. FIG. 8 is a view for explaining the layer arrangement of an electronic circuit substrate that can be used in each embodiment including this embodiment. Each black portion is a metal layer where the conductor pattern of a circuit or the ground conductor is arranged. A four-layered substrate is assumed here, and four metal layers of the first to fourth layers are arranged, as shown in FIG. 8. There are prepreg layers between the first and second layers, and between the third and fourth layers, and there is a core layer between the second and third layers. There is a solder resist to protect the conductor pattern of the circuit on the surface of each of the first and fourth layers. The stub according to each embodiment described above is formed on the third layer. Note that the stubs of FIG. 2A are formed in, for example, the second and third layers.

Figure 7A:
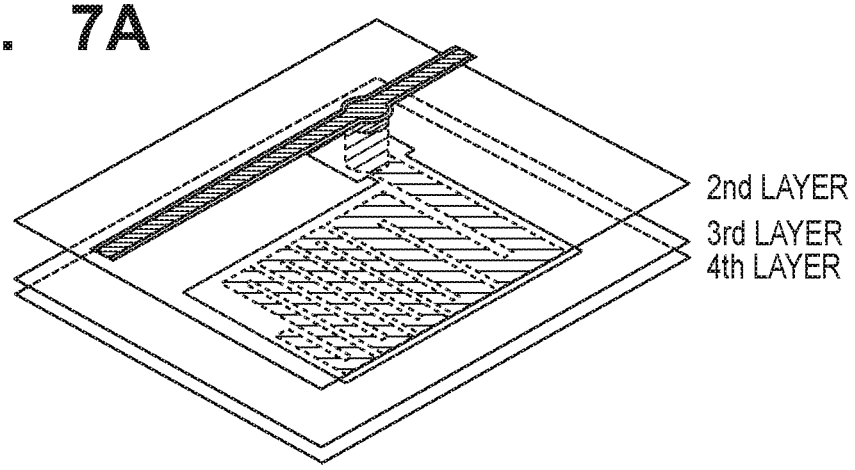
FIGS. 7A to 7F are views and graphs each showing an example of the arrangement and characteristic of a band-stop filter according to the fourth embodiment.

FIG. 7A shows the arrangement of a filter which is assumed to be mounted on a wireless LAN module substrate, and stops the propagation of electromagnetic waves in a 2.4-GHz band and a 5-GHz band. FIG. 7D shows a simulation result of the characteristic of a filter structure in FIG. 7A. Note that FIG. 7A shows a structure obtained by removing a ground conductor arranged on the same surface as a signal line in order to help understand the structure. Due to the principle of a coplanar line, however, such a ground conductor is formed on the same surface as a matter of course, although not shown. As has been described in the third embodiment, it is possible, by reducing the line width of the portion of the stub including the open end, to form a filter which stops both frequency bands of the 2.4-GHz band and the 5-GHz band. As seen in FIG. 7D, good attenuation characteristics are obtained in the both frequency bands of the 2.4-GHz band and the 5-GHz band by the filter structure of FIG. 7A.

Figure 7B:
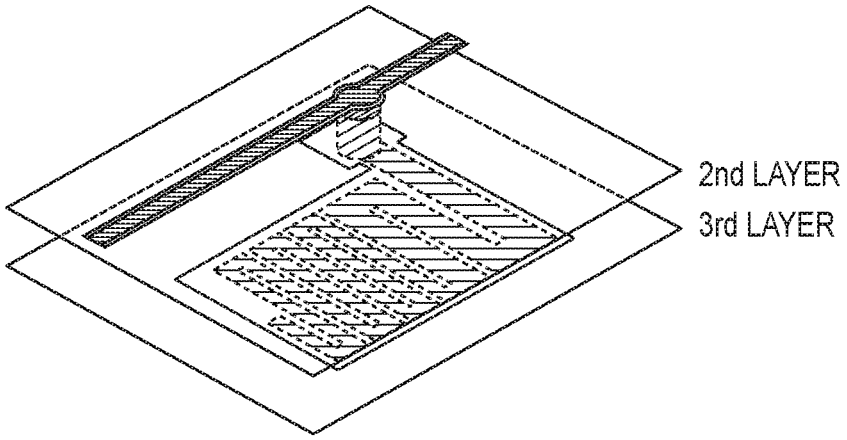

FIG. 7B shows a structure obtained by removing, from the structure of FIG. 7A, the ground conductor in the lower layer of the stub facing the layer where the stub is arranged. That is, it is an arrangement obtained by removing the ground conductor arranged in the fourth layer of FIG. 8. FIG. 7E shows a simulation result of the characteristic in FIG. 7B. Comparing FIG. 7D with FIG. 7E, it is found that both the first stop band and the second stop band further shift to the high frequency side in the characteristic of FIG. 7E as compared to that of FIG. 7D.

As described above, the total length of a resonance conductor needs a length equal to a quarter of an electrical length at the frequency of a stop band. That is, if the stop band is to be at a low frequency, the length of the resonance conductor has to be increased accordingly. In contrast, it is found, from the fact that both the first stop band and the second stop band further shift to the high frequency side in the characteristic of FIG. 7E as compared to that of FIG. 7D, that the ground conductor in the lower layer of the stub acts to make the electrical length of a current flowing onto the stub shorter. This is because if an arrangement is adopted in which a ground conductor having a large area exists in the lower layer of the stub, the electrical length becomes shorter by increasing the phase constant of an electromagnetic wave propagating through the stub when the resonance conductor resonates. That is, it is possible to reduce the size of the stub by arranging a planar ground conductor having a large area in the lower layer of the stub (a layer on a side opposite to a layer where a signal line is arranged when viewed from a layer where the stub is arranged).

Figure 7C:
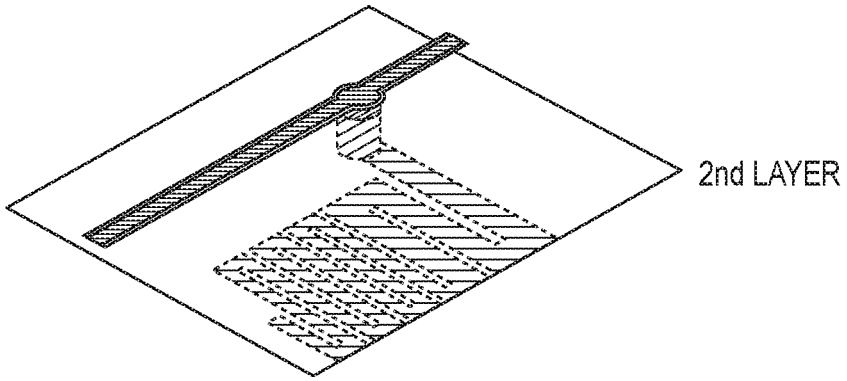
Figure 7D:
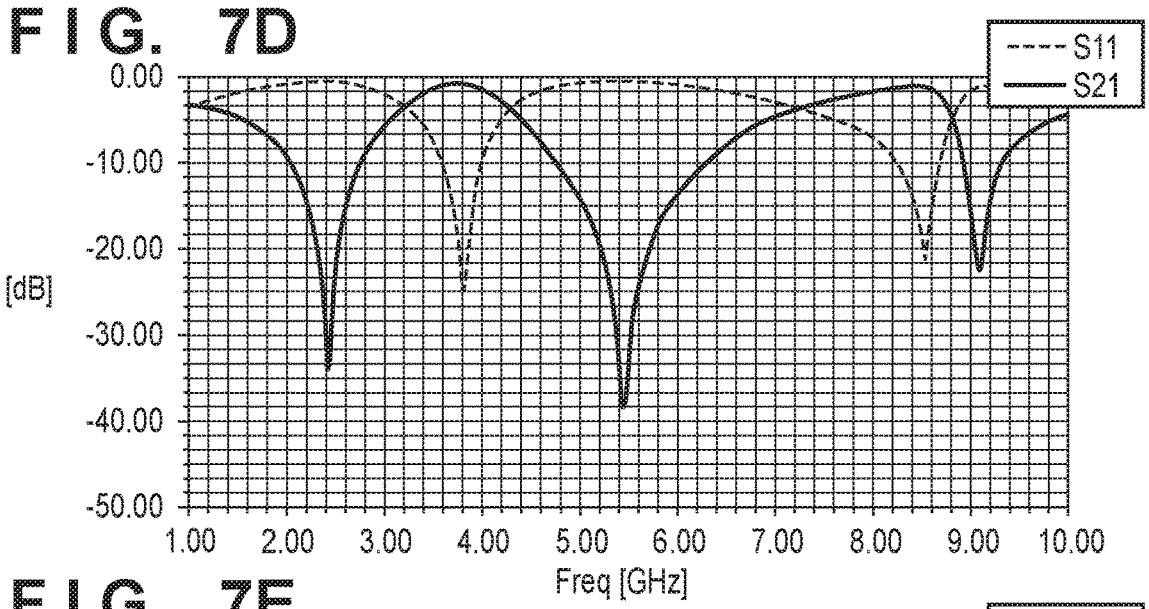
Figure 7E:
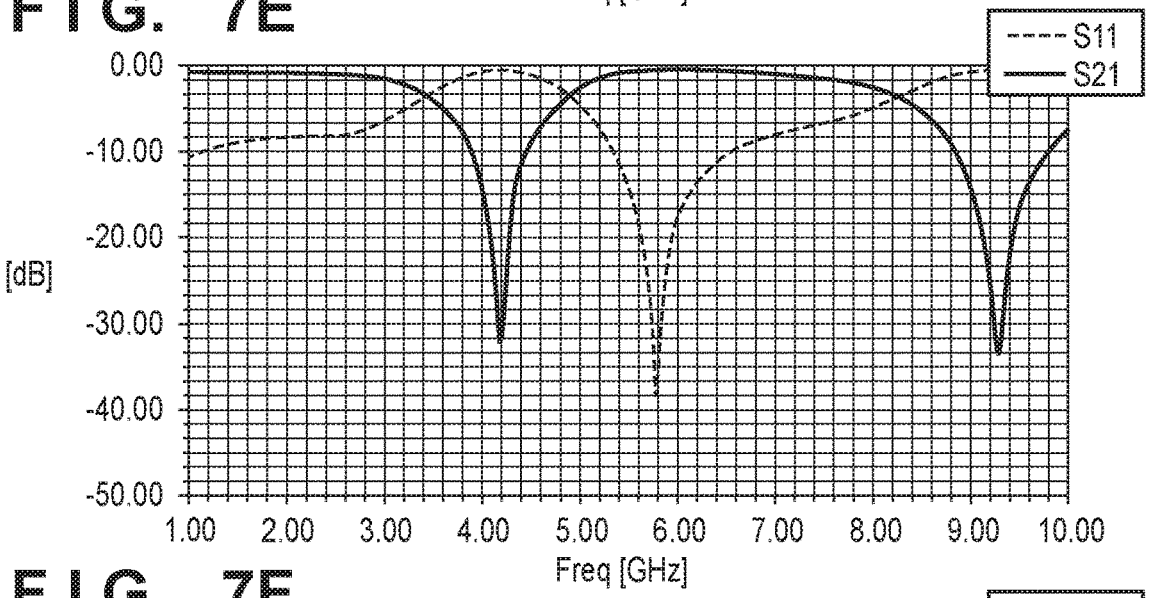
Figure 7F:
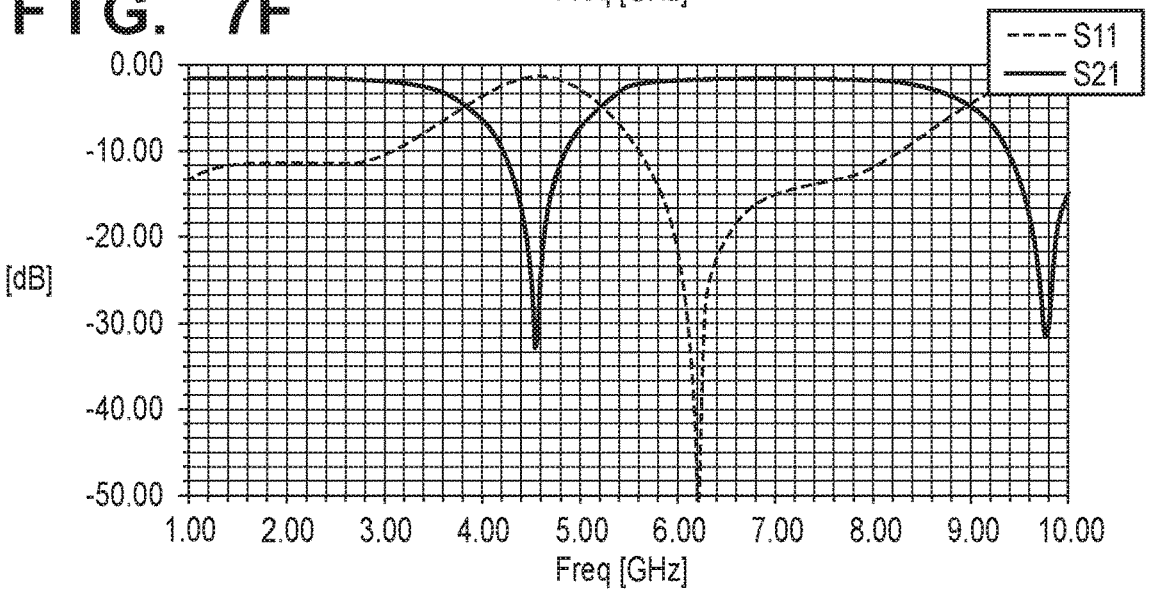

Next, FIG. 7C shows a structure obtained by further removing, from the structure of FIG. 7B, a ground conductor arranged in the same layer as the stub and surrounding the stub. That is, it is an arrangement obtained by removing the ground conductors arranged in the third and fourth layers of FIG. 8. FIG. 7F shows a simulation result of the characteristic in FIG. 7C.

Comparing the characteristic in FIG. 7E with that in FIG. 7F, it is found that both the first stop band and the second stop band further shift to the high frequency side in the characteristic of FIG. 7F as compared to that of FIG. 7E. From this, it is found that the ground conductor surrounding the stub acts to make the electrical length of the current flowing onto the stub shorter. This is because if an arrangement is adopted in which a ground conductor having a large area exists so as to surround the stub, the electrical length becomes shorter by increasing the phase constant of the electromagnetic wave propagating through the stub when the resonance conductor resonates. That is, it is possible to reduce the size of the stub by arranging the ground conductor so as to surround the stub.

As described above, it is possible to reduce the size of the resonance conductor by arranging the ground conductor around the resonance conductor including the via and the stub. If an electromagnetic wave (noise) in a frequency band of a stop band propagates through the transmission line, resonance may occur in the resonance conductor, emitting the electromagnetic wave (noise) into a space. To cope with this, the top and bottom of the stub are sandwiched by the ground conductors and in addition, the stub is arranged to be surrounded by the ground conductor as described in the first to third embodiments, making it possible to prevent the undesired electromagnetic wave as described above from being emitted into the space.

Fifth Embodiment

In this embodiment, a filter structure in which one resonance conductor is formed by using a plurality of layers will be described. An effect obtained by removing some of ground conductors around the resonance conductor in such a structure will also be described. A substrate having the layer arrangement as in FIG. 8 is also used in the filter structure according to this embodiment.

Figure 9A:
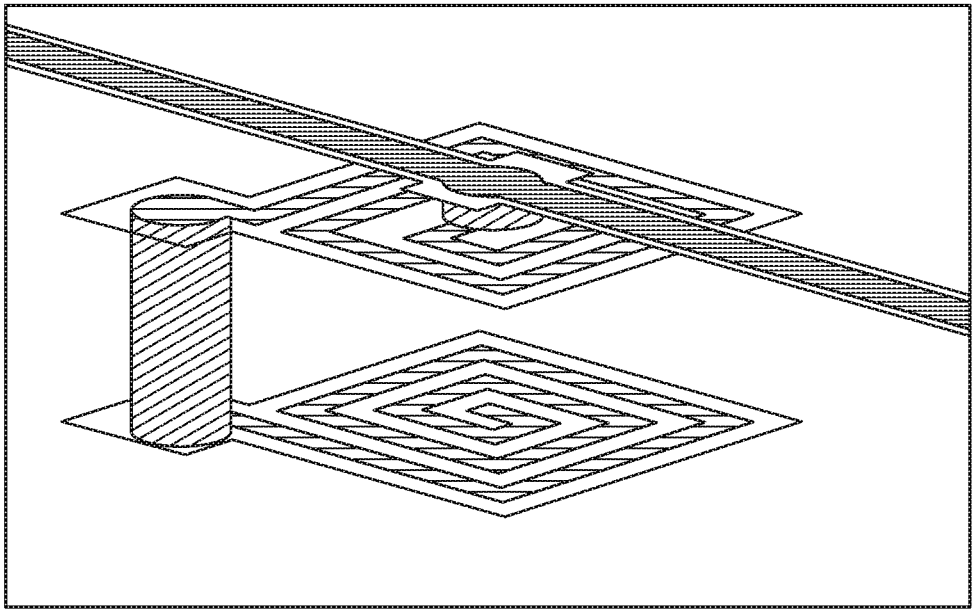
FIGS. 9A and 9B are a view and a graph showing an example of the arrangement and characteristic of a band-stop filter according to the fifth embodiment.

FIG. 9A shows the structure of a band-stop filter in which spiral-shaped stubs are formed in the second and third layers of FIG. 8, respectively, and the end portions of the respective stubs are connected with vias. The end portion of the stub formed in the second layer which is not connected to the stub in the third layer is connected to a transmission line, and the end portion of the stub arranged in the third layer which is not connected to the stub in the second layer is an open end. An area per layer needed to form a stab arrangement is decreased by forming the stubs by using two layers as described above, making it possible to mount them even on a small electronic circuit substrate. Note that also in the structure of FIG. 9A, ground conductors are formed in the first and fourth layers, and the ground conductors are arranged in the top and bottom of the stub. Ground conductors are also arranged in the second and third layers where the stubs are arranged so as to surround the stubs. This makes it possible to seek downsizing of each stub and suppress emission of noise into a space, as has been described in the fourth embodiment.

Figure 10A:
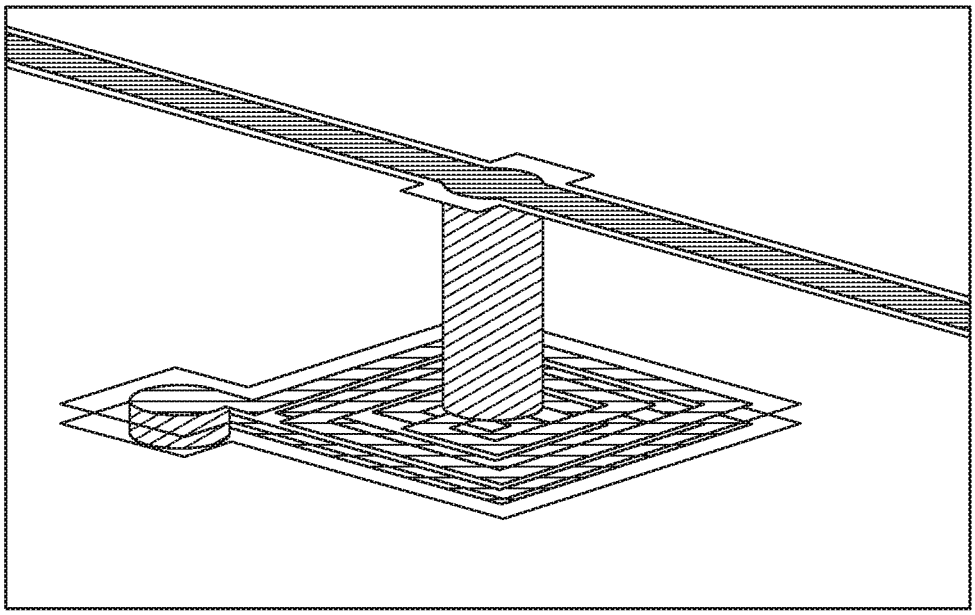
FIGS. 10A and 10B are a view and a graph showing an example of the arrangement and characteristic of the band-stop filter according to the fifth embodiment.

FIG. 10A shows the structure of a band-stop filter in which spiral-shaped stubs are formed in two layers of the third and fourth layers of FIG. 8, respectively, and the end portions of the respective stubs are connected with vias. The end portion of the stub arranged in the third layer which is not connected to the stub in the fourth layer is connected to a transmission line, and the end portion of the stub arranged in the fourth layer which is not connected to the stub in the third layer is an open end. Also with this arrangement, an area per layer needed to form a stab arrangement is decreased by forming the stubs by using two layers, making it possible to mount them even on a small electronic circuit substrate.

Figure 9B:
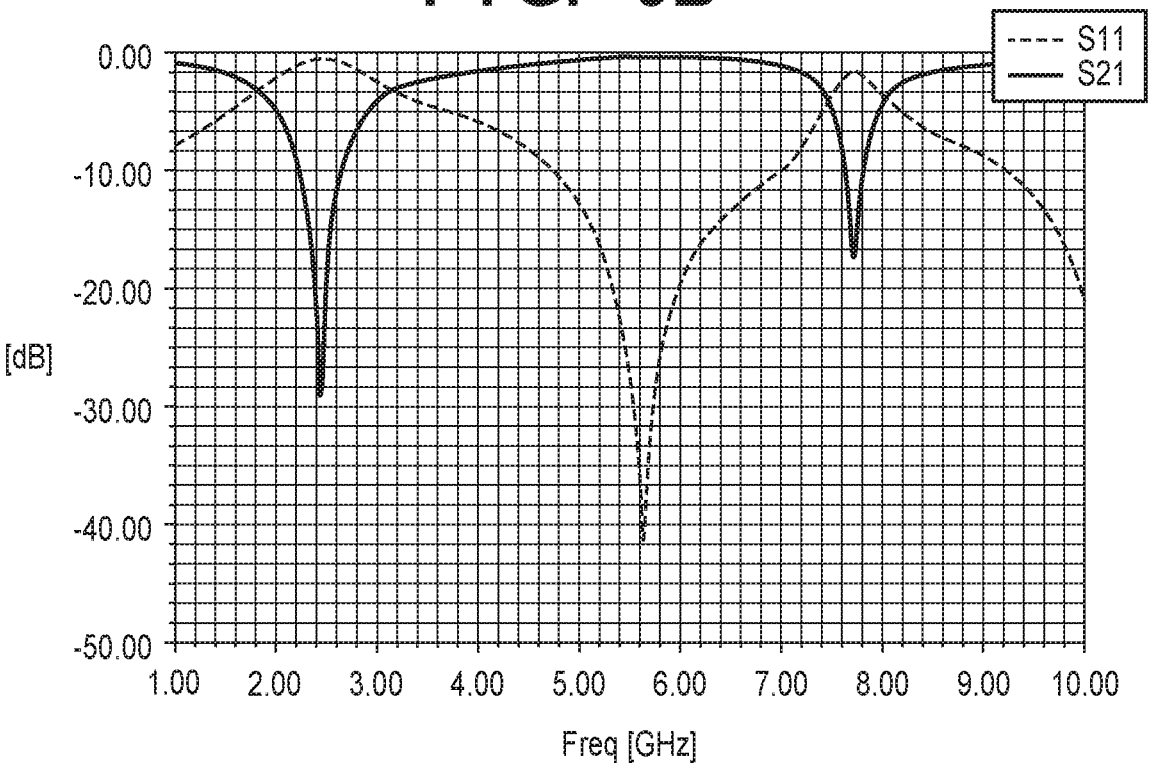
Figure 10B:
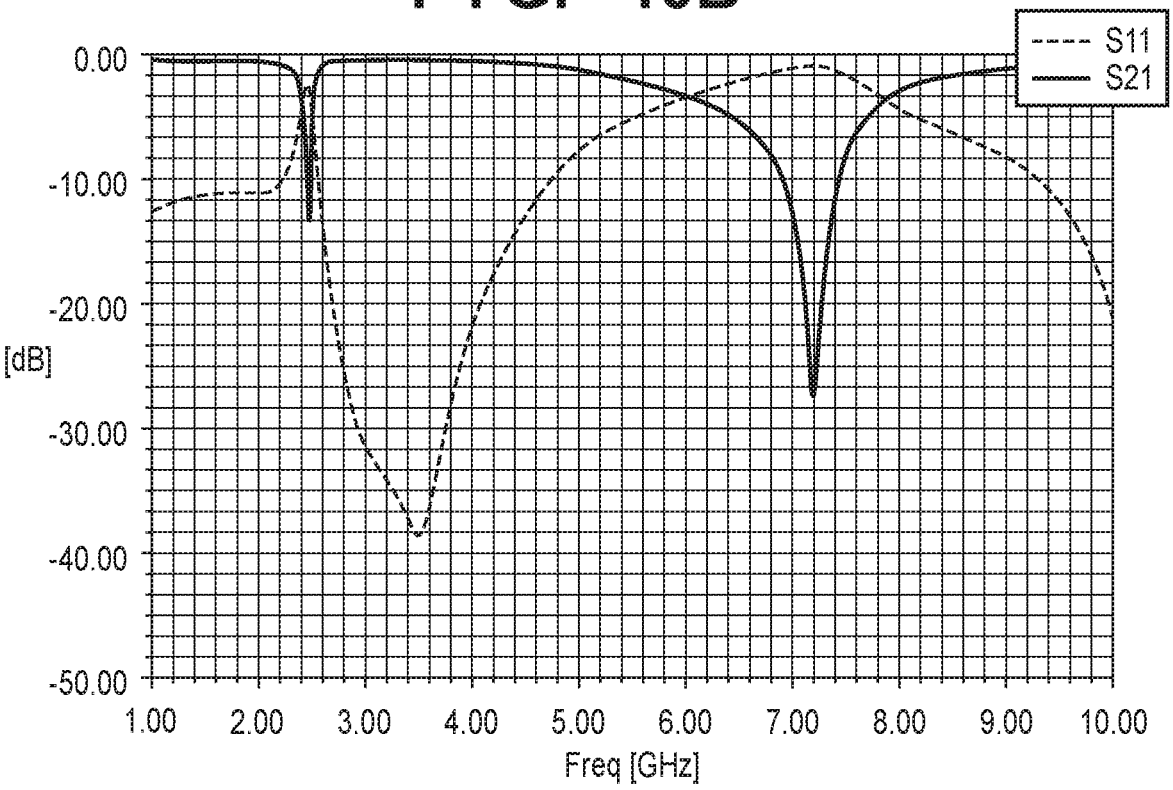

Note that in FIG. 10A, while a ground conductor is arranged in the second layer on the upper surface of the stub, a ground conductor is not formed on the lower surface of the stub. On the other hand, in the third and fourth layers where the stubs are arranged, ground conductors are arranged so as to surround the stubs. Note that each stub has a uniform line width, and the line widths of the stubs arranged in the third and fourth layers are 0.1 mm. Referring to FIG. 10B, it is found that the band widths of the first stop band and the second stop band become narrower as compared with the characteristic regarding the filter structure of FIG. 9A shown in FIG. 9B. It is considered that this is due to weak coupling between the stubs and the ground conductors. "Coupling" here refers to any electromagnetic coupling that can include electrostatic coupling (capacitive coupling), magnetic coupling (inductive coupling), or electromagnetic coupling in which both of these are mixed. As an electromagnetic wave propagating through a transmission line, if a band (pass band) to be passed through by the electromagnetic wave and a band (stop band) to stop the propagation of the electromagnetic wave are close to each other, a passband characteristic may be influenced by a large band width of a stop band of the filter. In such a case, the bandwidth of the stop band can be narrowed by removing some of the ground conductors around the stubs as in FIG. 10A. In this case, however, referring to a transmission coefficient S21 of FIG. 10B, it is found that attenuation is decreased as the bandwidth becomes narrower.

Figure 11A:
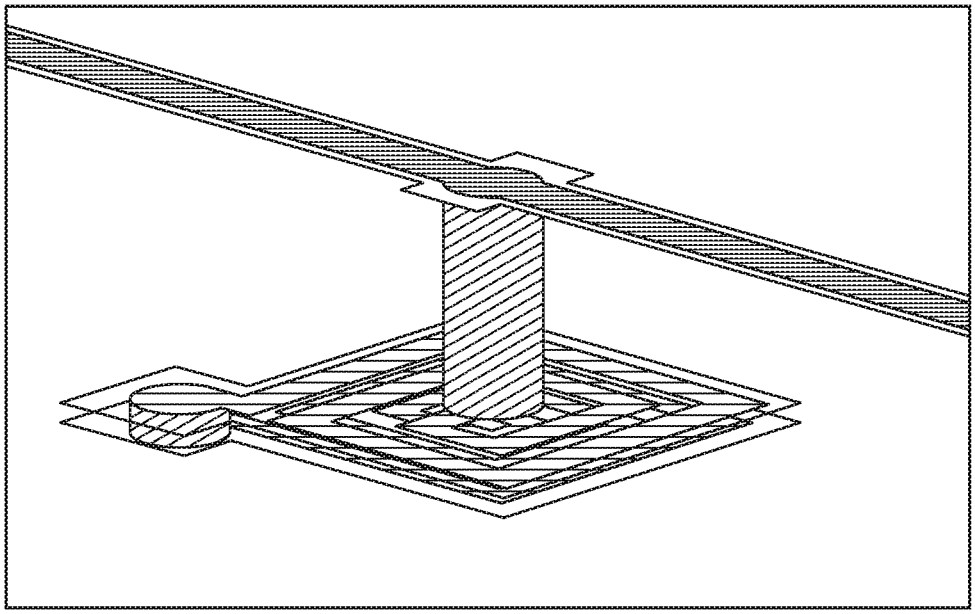
FIGS. 11A and 11B are a view and a graph showing an example of the arrangement and characteristic of the band-stop filter according to the fifth embodiment.
Figure 11B:
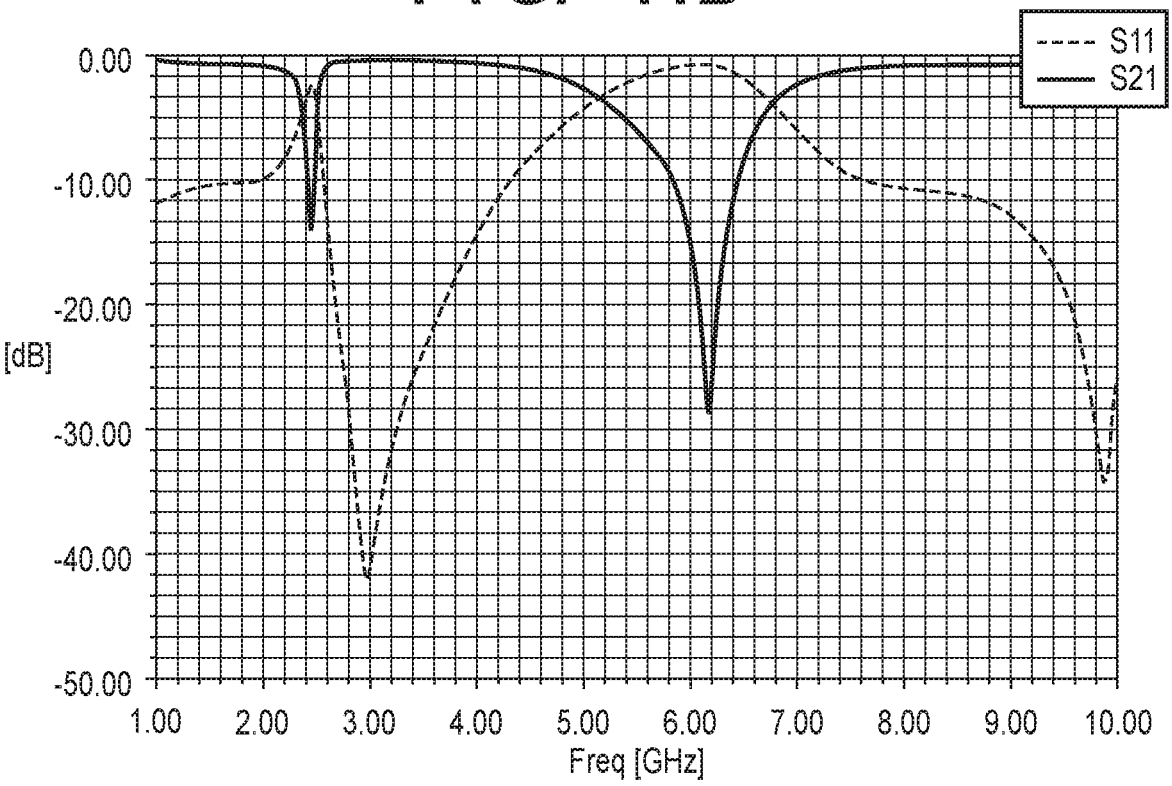

As in FIG. 10A, FIG. 11A shows a filter structure in which stubs are formed in two layers of the third and fourth layers. While a ground conductor is arranged in the second layer on the upper surface of the stub, a ground conductor is not arranged on the lower surface of the stub. In the third and fourth layers where the stubs are arranged, ground conductors are arranged so as to surround the stubs. Note that the line widths of the stubs are not uniform, the line width of the stub arranged in the third layer is 0.15 mm, and the line width of the stub arranged in the fourth layer is 0.05 mm. Comparing the characteristic in FIG. 10B with that in FIG. 11B, the second stop band in FIG. 11B is about 6.2 GHz, and the second stop band in FIG. 10B is 7.2 GHz. That is, it is found that the second stop band of a band-stop filter in FIG. 11B is on a lower frequency side than the second stop band of the band-stop filter in FIG. 10B. In the film structure of FIG. 11A, the stub arranged in the third layer and the stub arranged in the fourth layer are connected with a via as described above. At this time, the stub arranged in the fourth layer corresponds to a stub on an open end side. It is therefore possible, by making the line width of the stub on the open end side narrower, to obtain the same effect as in the arrangement of the third embodiment. That is, it is also possible, by reducing the line width of the portion of the stub including the open end and changing the line-width ratio, to obtain the same effect as in the third embodiment in the arrangement according to this embodiment in which the stubs are formed by using two layers, and coupling between the stubs and the ground conductors is weakened. Similarly, the effects described in the second and third embodiments can also be obtained in the arrangement of the band-stop filter of this embodiment.

On the other hand, as the area occupied by the stub line width is larger, large attenuation is obtained in the transmission coefficient S21, as has been described in the third embodiment. This is considered so because coupling between the stubs and the ground conductors is strengthened as the area occupied by the stub line width is larger. That is, if coupling between the stubs and the ground conductors is strong, a large attenuation characteristic is obtained, and the band width of a stop band becomes larger in a desired frequency band. On the other hand, if coupling between the stubs and the ground conductors is weak, a small attenuation characteristic is obtained, and the band width of the stop band becomes smaller in the desired frequency band. Coupling between the stubs and the ground conductors can be strengthened by increasing the stub line width, surrounding the stubs by the ground conductors, or decreasing the distances between the stubs and the ground conductors. On the other hand, coupling between the stubs and the ground conductors can be weakened by reducing the stub line width, increasing the distances between the stubs and the ground conductors, or removing the ground conductor near the stub.

Sixth Embodiment

In this embodiment, a case will be examined in which a plurality of resonance conductors are connected to a transmission line. A method of connecting a stub to the transmission line is performed as in FIG. 2A of the first embodiment. It is possible, by connecting the resonance conductors to the transmission line as in FIG. 2A, to minimize the number of connection points to a signal line of the resonance conductors connected to the signal line. Degradation in signal is suppressed by decreasing discontinuous parts of the signal line. Note that according to the above-described embodiments, a plurality of desired stop bands can be obtained in one resonance conductor by changing a stub line width or the length ratio between a portion having a thick line width and a portion having a thin line width. It is therefore possible, by changing the line width of each stub in FIG. 2A by the methods described in the second and third embodiments, to form a band-stop filter which stops the propagation of electromagnetic waves in at least four desired frequency bands in total. Note that not two stubs as in FIG. 2A but more stubs may be connected. In that case, a band-stop filter which stops more frequency bands can be formed.

Seventh Embodiment

In this embodiment, a filter mounted on a wireless module substrate of a wireless communication apparatus complying with the standard of a wireless LAN (IEEE802.11b/g/n) and formed by a conductor pattern will be examined. In IEEE802.11b/g/n, a communication apparatus performs communication by a radio wave in a frequency band of a 2.4-GHz band. Therefore, assuming a transmission line through which a signal in the 2.4-GHz band transmits, a filter which stops the propagation of a twofold harmonic (4.9-GHz band) and a threefold harmonic (7.4-GHz band) of that 2.4-GHz band will be examined below. That is, the band-stop filter formed by the conductor pattern which stops the propagation of two frequency bands of the 4.9-GHz band and the 7.4-GHz band will be considered. That is, the band-stop filter which sets the above-described frequency band f1 of the first (low frequency side) stop band as the 4.9-GHz band and the above-described frequency band f2 of the second (high frequency side) stop band as the 7.4-GHz band will be examined.

Figure 12A:
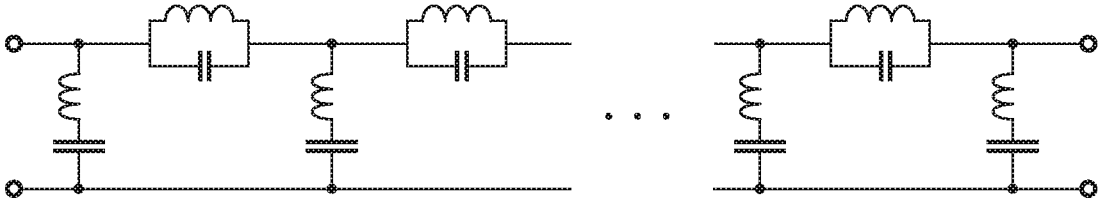
FIG. 12A PRIOR ART
FIGS. 12A and 12B are equivalent circuit diagrams each showing an example of the arrangement of a conventional band-stop filter.
Figure 12B:
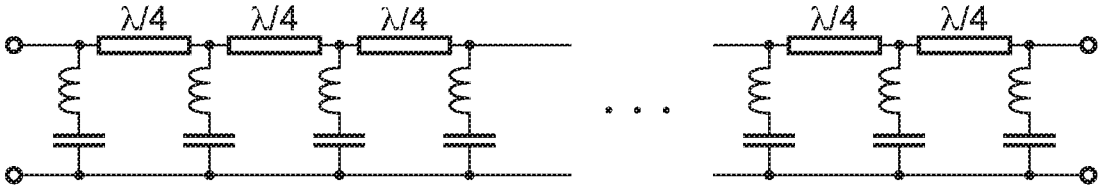
FIG. 12B PRIOR ART

The band-stop filter can be implemented by circuits as in FIGS. 12A and 12B. FIGS. 12A and 12B are equivalent circuit diagrams each showing an example of the arrangement of a conventional band-stop filter. Such a band-stop filter stops the propagation of one frequency band to be denoted as f1. As shown in FIG. 12A, the band-stop filter having the frequency band f1 as a stop band can be implemented by combining a parallel resonance circuit and series resonance circuits, and resonating the parallel resonance circuit and the series resonance circuits at the frequency f1. The band-stop filter shown in an equivalent circuit of FIG. 12A may be implemented by the arrangement as in FIG. 12B. As shown in FIG. 12B, letting $\lambda$ be an electrical length of an electromagnetic wave at the frequency f1, the band-stop filter can implement the same characteristic as in FIG.

12A by arranging series resonance circuits apart from each other by a distance of λ/4. That is, each distance of λ/4 shown in FIG. 12B has an impedance inverting effect, making it possible to implement the parallel resonance circuit as shown in FIG. 12A by connecting transmission lines each having a length of λ/4 to the series resonance circuits. Such transmission lines each having the length of λ/4 are called immittance inverters.

A method of implementing the series resonance circuits in FIG. 12B when the band-stop filter is formed by the conductor pattern on a coplanar line will now be described. Each series resonance circuit in FIG. 12B can be implemented by, for example, connecting a conductor pattern having an open end of a predetermined length to a transmission line like the coplanar line. If the conductor pattern is directly connected to the transmission line, the conductor pattern is formed with a length equal to λ/4 (λ denotes the electrical length) of a frequency at which propagation is to be stopped. If the conductor pattern is connected to the transmission line through a via, a length obtained by summing the length of the conductor pattern and the length of the via is formed to be the length equal to λ/4 (λ denotes the electrical length) of a frequency at which transmission is to be stopped. Note that the band-stop filter in this embodiment is also formed on an electronic circuit substrate having the layer arrangement shown in FIG. 8.

Figure 13A:
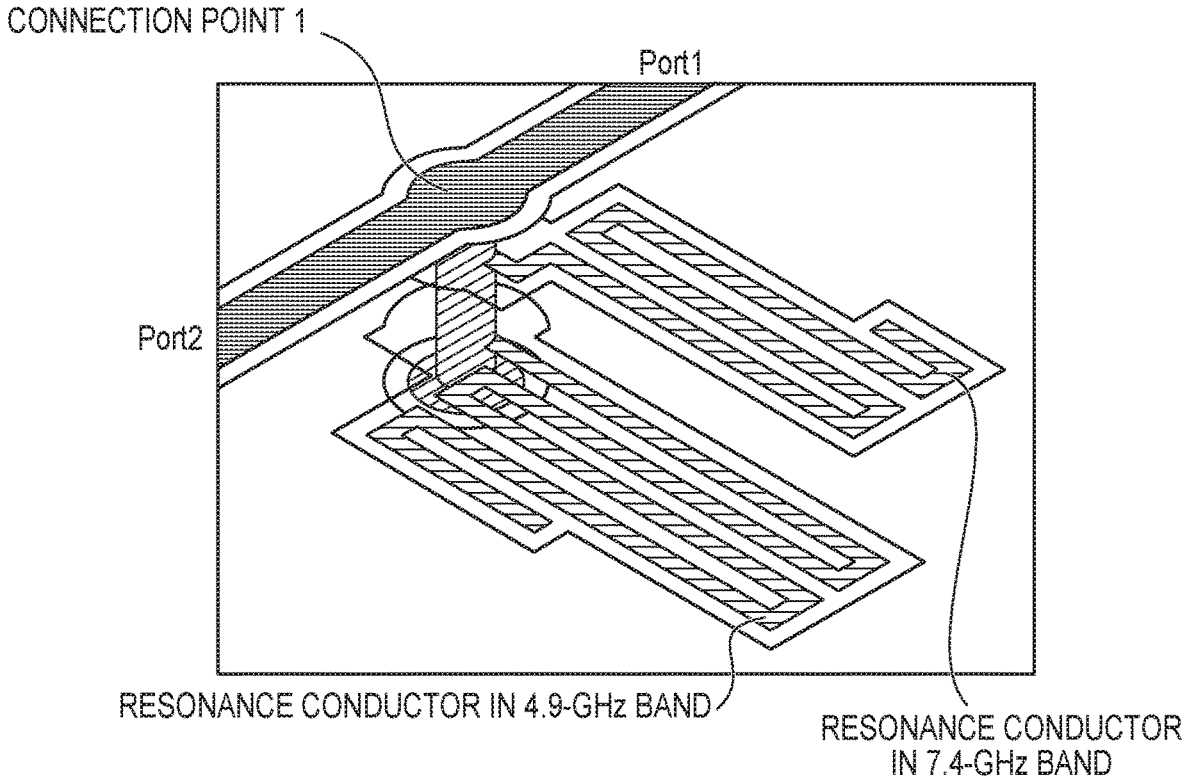
FIGS. 13A and 13B are a view and a graph showing an example of the arrangement and characteristic of a band-stop filter according to the seventh embodiment.
Figure 13B:
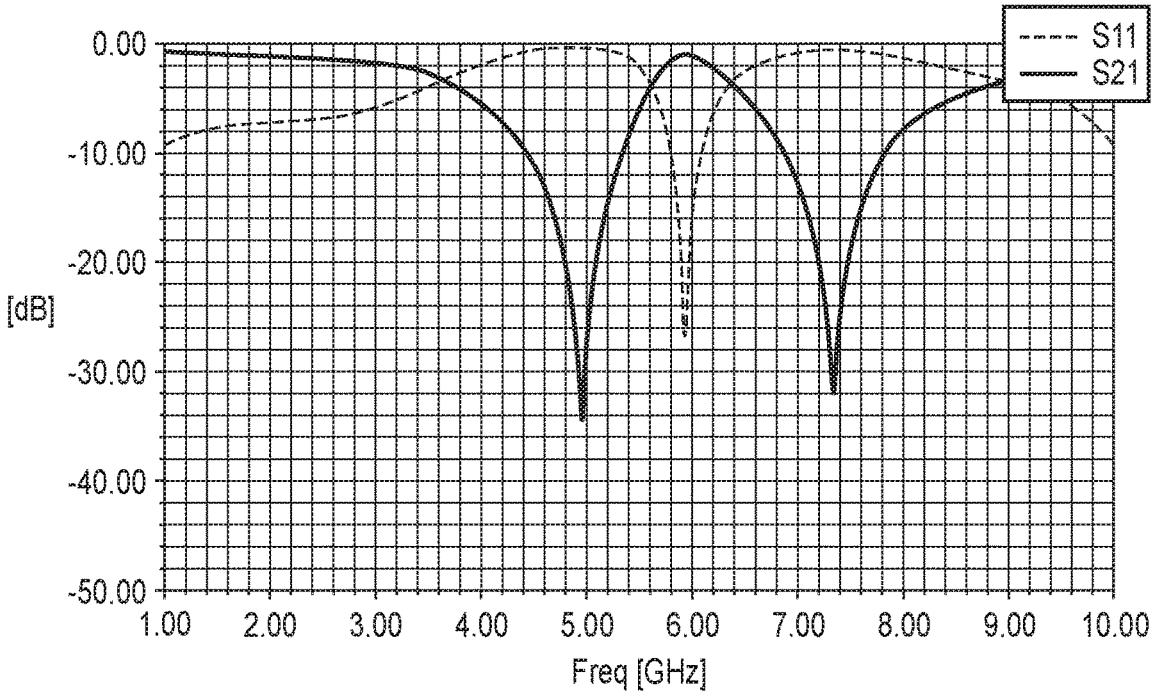

First, as shown in FIG. 13A, a resonance conductor which resonates in two frequency bands of the 4.9-GHz band and the 7.4-GHz band is connected to a coplanar line. As described above, this resonance conductor is formed to include a via and conductor patterns (stubs) arranged in respective layers on a dielectric substrate. In this arrangement, the via is connected to the coplanar line in one portion, and two meander-shaped stubs branch off from that via. This position at which the via is connected to the coplanar line will be referred to as "connection point 1" hereinafter. FIG. 13B shows a simulation result of a transmission coefficient S21 and a reflectance coefficient S11 at input/output ends (Port1 and Port2) of the coplanar line in FIG. 13A. As seen in FIG. 13B, in the arrangement of FIG. 13A, the propagation of electromagnetic waves can be stopped in the 4.9-GHz band serving as the twofold harmonic and the 7.4-GHz band serving as the threefold harmonic of the 2.4-GHz band. In FIG. 13A, letting λ1 be an electrical length of the electromagnetic wave in the 7.4-GHz band propagating through the resonance conductor, the via and the conductor pattern arranged in the second layer are formed to have the total length of λ¼, resonate in the 7.4-GHz band, and form a stop band in the 7.4-GHz band. Also, letting λ2 be an electrical length of the electromagnetic wave in the 4.9-GHz band propagating through the resonance conductor, the via and the conductor pattern arranged in the third layer are formed to have the total length of λ¾, resonate in the 4.9-GHz band, and form a stop band in the 4.9-GHz band. That is, it is possible, by adjusting the total length of the via and each conductor pattern (stub) formed on the dielectric substrate, to adjust a frequency band (resonating frequency band) serving as a stop band. It is also possible, by further increasing conductor patterns branching off from the via, to stop the propagation of electromagnetic waves in two or more frequency bands. In this embodiment, the structure shown in FIG. 13A is used as a structure which stops two frequency bands of the 4.9-GHz band and the 7.4-GHz band. However, the band-stop filter using the stubs different in line width as described in the second and third embodiment may be used.

It is found from the transmission coefficient S21 of FIG. 13B that the stop bands are formed in the 4.9-GHz band and the 7.4-GHz band, and attenuation is obtained in two desired frequency bands, but a 2.4-GHz band serving as a frequency band to be allow to pass through is also attenuated by 1 dB or more. That is, the filter structure of FIG. 13A also attenuates the frequency band to be allow to pass through. The band-stop filter can improve a passband characteristic and a stop-band characteristic by increasing the number of stages of the filter. Thus, this embodiment assumes that a resonance conductor operating in the 4.9-GHz band and a resonance conductor operating in the 7.4-GHz band are increased by one for each.

Figure 14A:
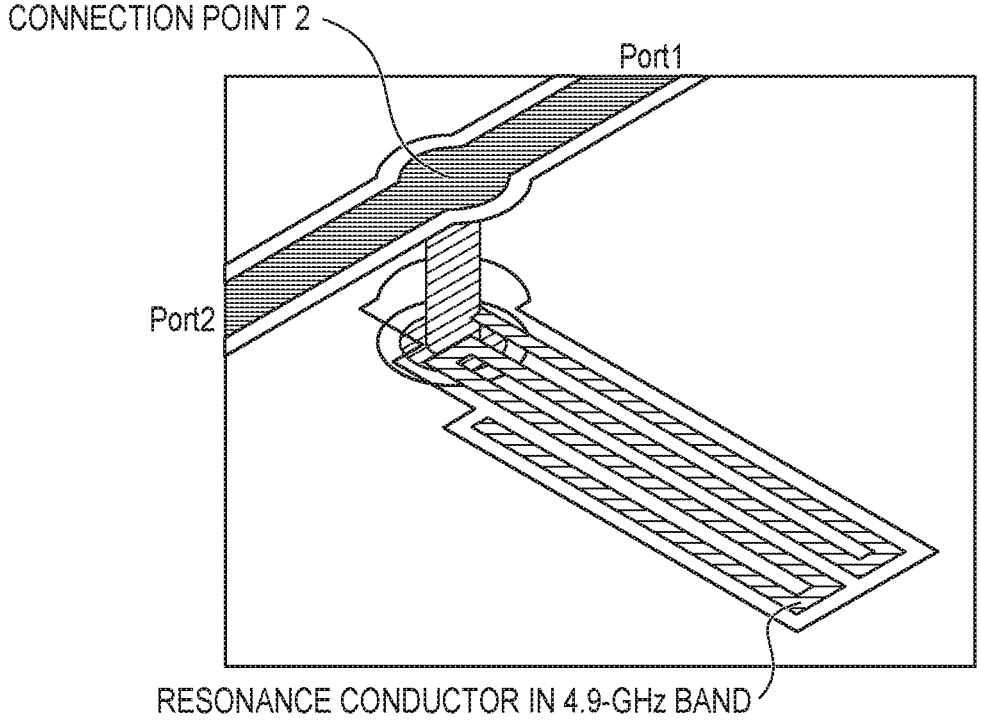
FIGS. 14A and 14B are a view and a graph showing an example of the arrangement and characteristic of a band-stop filter which includes a resonance conductor resonating in a 4.9-GHz band.
Figure 14B:
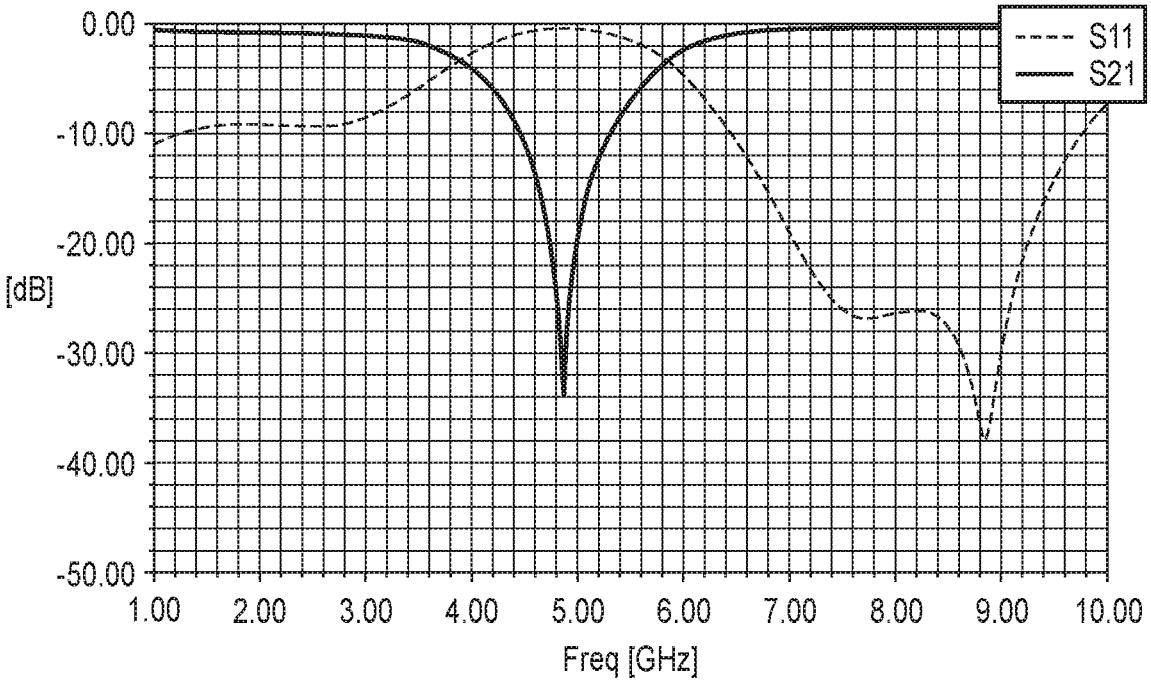

As shown in FIG. 14A, the resonance conductor resonating in the 4.9-GHz band is connected to a coplanar line. This resonance conductor is formed by a via and a stub arranged in the third layer on a dielectric substrate. The via is connected to the coplanar line in one portion. This position at which the via is connected to the coplanar line will be referred to as "connection point 2" hereinafter. FIG. 14B shows a simulation result of the transmission coefficient S21 and the reflectance coefficient S11 at the input/output ends (Port1 and Port2) of the coplanar line in FIG. 14A. As seen in FIG. 14B, with the arrangement of FIG. 14A, the propagation of an electromagnetic wave can be stopped in the 4.9-GHz band serving as the twofold harmonic of the 2.4-GHz band.

Figure 15A:
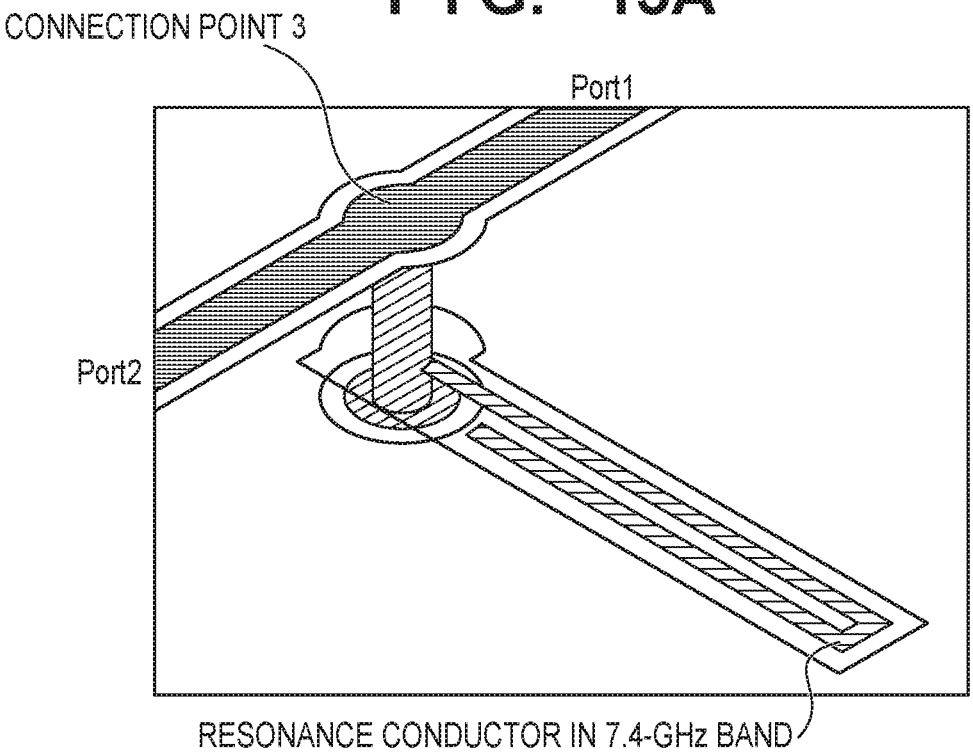
FIGS. 15A and 15B are a view and a graph showing an example of the arrangement and characteristic of a band-stop filter which includes a resonance conductor resonating in a 7.4-GHz band.
Figure 15B:
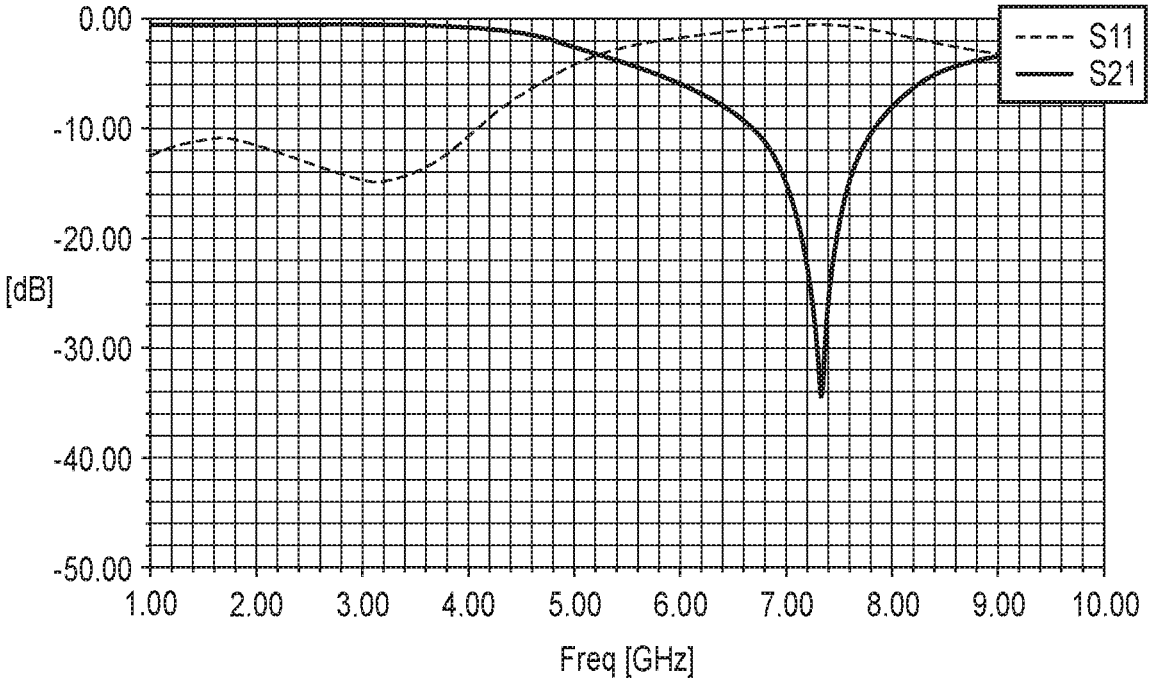

Next, as shown in FIG. 15A, the resonance conductor resonating in the 7.4-GHz band is connected to a coplanar line. This resonance conductor is formed by a via and a stub arranged in the third layer on a dielectric substrate. The via is connected to the coplanar line in one portion. This position at which the via is connected to the coplanar line will be referred to as "connection point 3" hereinafter. FIG. 15B shows a simulation result of the transmission coefficient S21 and the reflectance coefficient S11 at the input/output ends (Port1 and Port2) of the coplanar line in FIG. 15A. As seen in FIG. 15B, with the arrangement of FIG. 15A, the propagation of an electromagnetic wave can be stopped in the 7.4-GHz band serving as the threefold harmonic of the 2.4-GHz band. As seen in FIGS. 14A and 14B, and FIGS. 15A and 15B, the frequency bands which stop the propagation of the electromagnetic waves are determined by adjusting the length of each stub (accordingly, each resonance conductor).

As described above, the structure which stops two frequency bands of the 4.9-GHz band and the 7.4-GHz band shown in FIG. 13A, the structure which stops the frequency band of the 4.9-GHz band shown in FIG. 14A, and the structure which stops the frequency band of the 7.4-GHz band shown in FIG. 15A have been determined.

A position at which each of these structures is connected to the coplanar line serving as transmission line will now be described. As described above, the equivalent circuit of the band-stop filter can be represented as in FIG. 12A and can further be represented as in FIG. 12B by using the immittance inverters. That is, considering first the band-stop filter which stops the frequency band of the 4.9-GHz band, the conductor pattern for stopping the frequency band of the 4.9-band is first connected, through the via, to the first position of the coplanar line serving as the transmission line. This corresponds to the first resonance portion of FIGS. 12A and 12B. The conductor pattern for stopping the frequency band of the 4.9-band is then connected, through the via, to the second position of the coplanar line serving as the transmission line. Note that the second position is a position away from the first position by a distance equal to λ¾ of 4.9

GHz. λ3 denotes a wavelength (electrical length) of a 4.9-GHz electromagnetic wave propagating through the coplanar line. This corresponds to the second resonance portion of FIGS. 12A and 12B. This makes it possible to implement the band-stop filter which stops the 4.9-GHz band.

Similarly, considering the band-stop filter which stops the frequency band of the 7.4-GHz band, the conductor pattern for stopping the frequency band of the 7.4-band is first connected, through the via, to the third position of the coplanar line serving as the transmission line. This corresponds to the first resonance conductor of FIGS. 12A and 12B. The conductor pattern for stopping the frequency band of the 7.4-band is then connected, through the via, to the fourth position of the coplanar line serving as the transmission line. Note that the fourth position is a position away from the third position by a distance equal to λ4/4 of 7.4 GHz. λ4 denotes a wavelength (electrical length) of a 7.4-GHz electromagnetic wave propagating through the coplanar line. This corresponds to the second resonance conductor of FIGS. 12A and 12B. This makes it possible to implement the band-stop filter which stops the 7.4-GHz band.

In order to form a band-stop filter which stops two frequency bands of the 4.9-GHz band and the 7.4-GHz band, it is considered that, for example, the band-stop filter in the 4.9-GHz band and band-stop filter in the 7.4-GHz band described above are connected continuously. In this case, an immittance inverter portion needs the length of λ3/4+λ4/4 which requires a large size. This may make it difficult to mount the filter on the electronic circuit substrate.

Figure 16A:
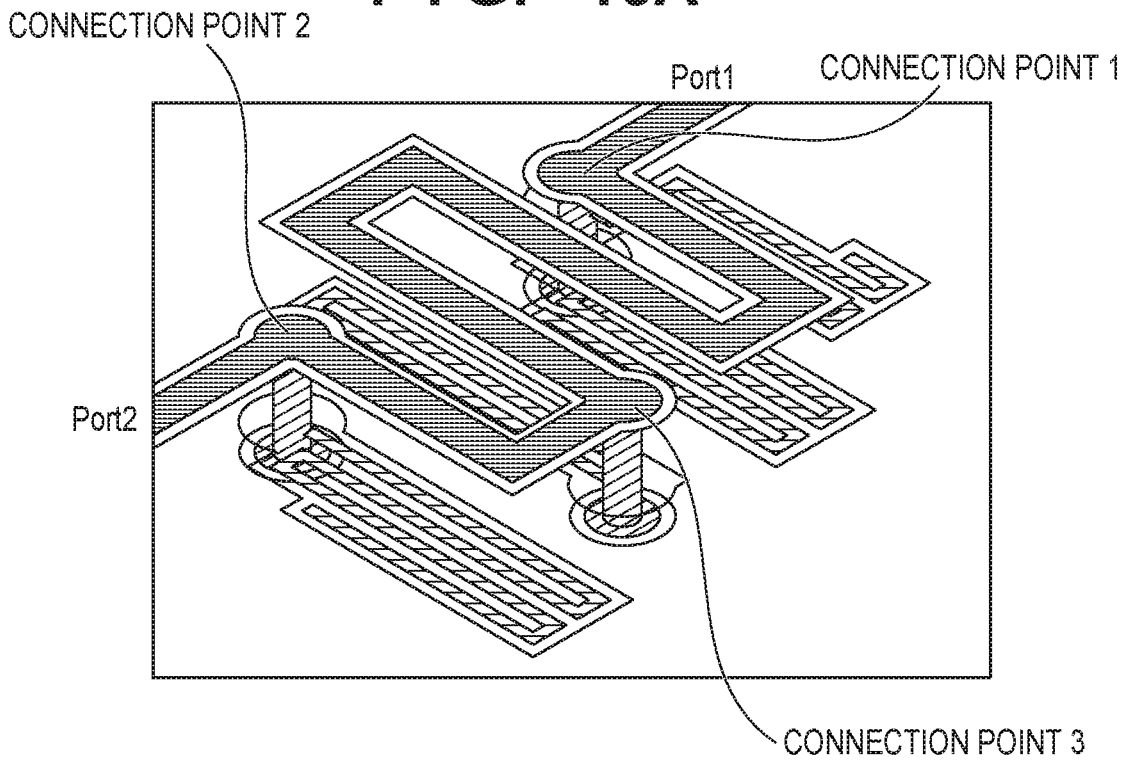
FIGS. 16A to 16D are views and graphs each showing an example of the arrangement and characteristic of the band-stop filter according to the seventh embodiment.

It is therefore considered that the length needed for the immittance inverter portion is reduced, seeking the downsizing of the band-stop filter. FIG. 16A shows the structure of a small band-stop filter to be described in this embodiment. As described above, the structure of FIG. 13A which stops two frequency bands of the 4.9-GHz band and the 7.4-GHz band is connected to the coplanar line at "connection point 1". The structure of FIG. 14A which stops the frequency band of the 4.9-GHz band is connected to the coplanar line at "connection point 2". In order to form the band-stop filter in the 4.9-GHz band, the distance from "connection point 1" to "connection point 2" needs to be the distance of λ3/4, as described above. On the other hand, the structure of FIG. 15A which stops the frequency band of the 7.4-GHz band is connected to the coplanar line at "connection point 3". In order to form the band-stop filter in the 7.4-GHz band, the distance from "connection point 1" to "connection point 3" needs to be the distance of λ4/4, as described above. Note that λ3>λ4 holds.

From the foregoing, it is possible, by connecting the structure which stops two frequency bands to "connection point 1" as in FIG. 13A, to set connection point 2 at a position away from connection point 1 by λ3/4 of 4.9 GHz. It is further possible to set connection point 3 at a position away from connection point 1 by λ4/4 of 7.4 GHz. This makes it possible to set the total length of the coplanar line needed to form the immittance inverters to λ3/4 (since λ3>λ4) to and seek the downsizing of the band-stop filter. That is, the positions of connection point 2 and connection point 3 starting from connection point 1 can be determined by arranging the resonance conductor which stops two frequency bands at connection point 1, making it possible to reduce the total length of the immittance inverter portion and to seek the downsizing of the band-stop filter. In an example of this embodiment, two frequency bands of the stop bands are 4.9 GHz and 7.4 GHz, and are comparatively apart from each other. Therefore, design has been performed ignoring interference between the resonance conductor connected to connection point 2 and operating in the 4.9-GHz band, and the resonance conductor connected to connection point 3 and operating in the 7.4-GHz band. When frequencies at which the resonance conductor connected to connection point 2 and the resonance conductor connected to connection point 3 resonate are close to each other, design needs to be performed considering interference between the resonance conductors.

Figure 16B:
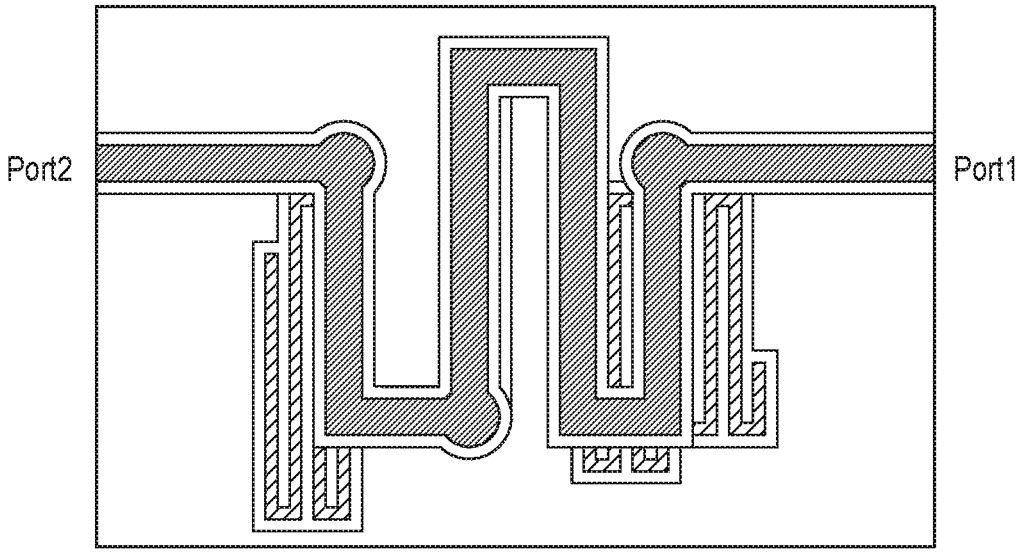
Figure 16C:
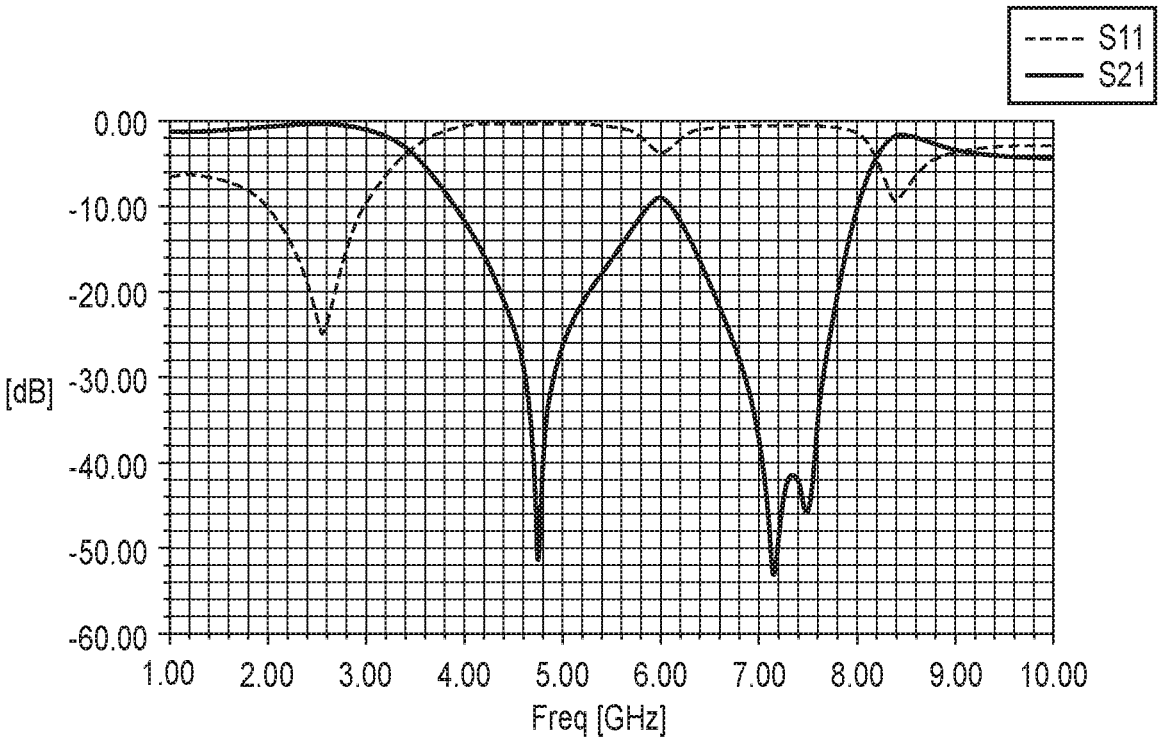

FIG. 16C shows a simulation result of the transmission coefficient S21 and the reflectance coefficient S11 at the input/output ends (Port1 and Port2) of the coplanar line in FIG. 16A. As seen in FIG. 16C, attenuation is small in 2.4 GHz serving as a passband, and a signal can be transmitted between the input/output ends. On the other hand, it is found that in two frequency bands of the 4.9-GHz band and the 7.4-GHz band, a sufficient attenuation amount can be secured, and a filter operates as the band-stop filter which stops the propagation of the electromagnetic waves in two frequency bands.

Note that in this embodiment, the pattern of each conductor connected to the coplanar line serving as the transmission line has a meander shape in order to reduce the length needed for the conductor. As described above, however, this can be a length equal to a quarter of the electrical length λ of a frequency at which propagation is to be stopped by the resonance conductor. Therefore, the shape of the conductor pattern may be another shape such as a straight line or a spiral shape. It is also possible to seek downsizing by arranging conductor patterns across a plurality of layers using a via.

In this embodiment, the stubs are arranged in the second and third layers of the electronic circuit substrate. However, all the stubs may be arranged in the same layer (for example, the third layer). In particular, when a resonance conductor resonates, an electromagnetic wave in a frequency band in which the resonance conductor resonates is emitted from the stub. Such emission may influence an electronic device and in addition, another electronic device or the like may be influenced by the electromagnetic wave emitted from the electronic circuit substrate. As described above, however, it is possible, by arranging each conductor to be sandwiched by ground conductors each having a large area arranged in the upper and lower layers of at least some of the stubs, to suppress the influence by electromagnetic waves emitted from the stubs. It is further possible, by arranging the stubs over two layers of the first and third layers, to reduce an area occupied by the stub in each layer. It is also possible to make each stub smaller (shorter) by adopting an arrangement in which the top and bottom of the stub are sandwiched by the ground conductors each having the large area as described above, allowing a reduction in size of the stub. As described above, with the band-stop filter reduced in size as in this embodiment, it becomes possible to mount the band-stop filter even on a small electronic circuit substrate.

Note that in this embodiment, a case has been described in which the four-layered substrate is used. However, a substrate having the number of layers other than four may be used. For example, in an one-layer substrate (single-sided substrate), it is possible to form a band-stop filter capable of obtaining the same effect as in the above-described arrangement by forming a stub in the same layer as a transmission line, and connecting the stub and the transmission line directly without a via. In a substrate having a plurality of layers, a band-stop filter can be formed in the same manner as the above-described method.

As described above, each immittance inverter needs a transmission line with the length of λ/4. In this embodiment, the coplanar line is adopted as the transmission line. In this case, λ denotes the electrical length of an electromagnetic wave propagating through the coplanar line in each frequency band. If the stub is arranged below the coplanar line of immittance inverter portion, the immittance inverter may not be regarded as the coplanar line due to interference between the coplanar line and the stub. Therefore, in this embodiment, not the stubs of the resonance conductors but the ground conductors are arranged below a signal line of the transmission line (coplanar line) of immittance inverter portion, as seen in FIG. 16A. This makes it possible to regard the immittance inverter portion as the coplanar line, facilitating design.

Note that in designing the immittance inverter portion of the band-stop filter in FIG. 16A described in this embodiment, first, the wavelength of a conductor-backed coplanar line is calculated, and the positions of connection point 1, connection point 2, and connection point 3 are determined by the above-described method. Then, the positions of connection point 1, connection point 2, and connection point 3 are adjusted, and the length of the transmission line in the immittance inverter portion is adjusted so as to obtain a good passband characteristic in a desired frequency band (the 2.4-GHz band in this embodiment). FIG. 16B shows the band-stop filter of FIG. 16A when viewed from a direction perpendicular to a substrate plane. As seen in FIG. 16B, the transmission line (coplanar line) in the immittance inverter portion has a meander shape. The total length of the band-stop filter can be reduced by having such a shape. Although not explicitly shown in each view of the band-stop filter according to this embodiment, it is possible to further stabilize the characteristic of the band-stop filter by surrounding the resonance conductor with the via.

Figure 16D:
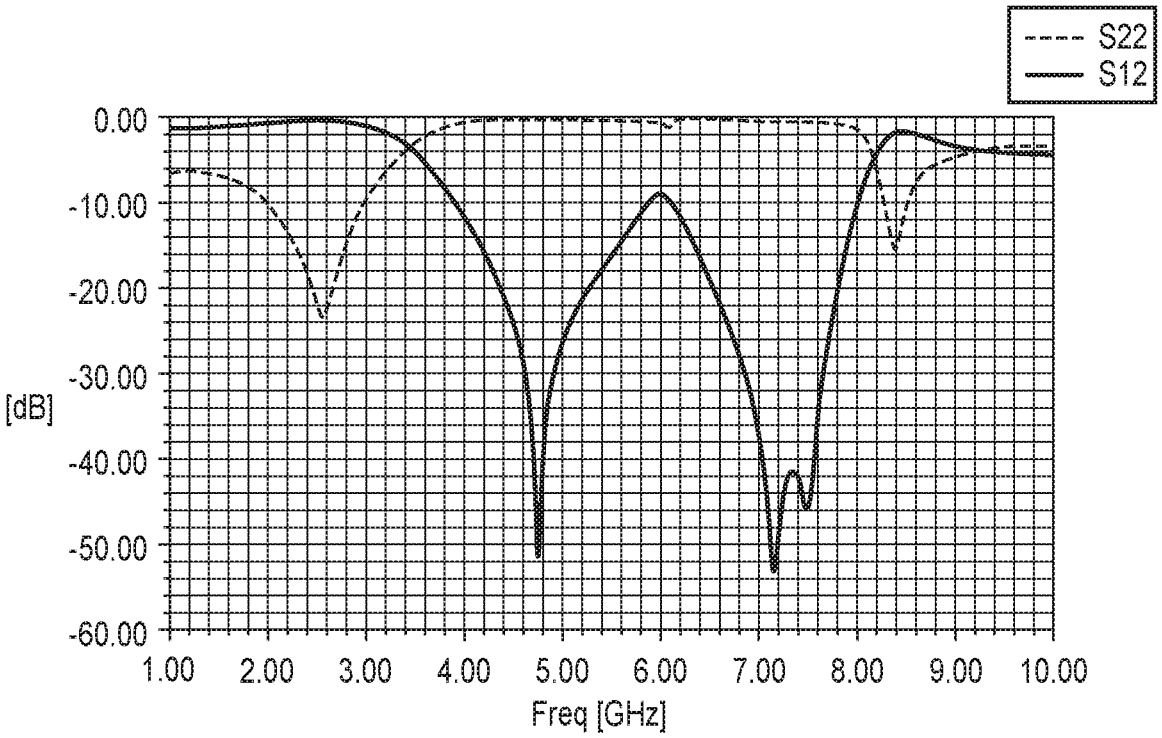

FIG. 16D shows a simulation result of a transmission coefficient S22 and a reflectance coefficient S12 at the input/output ends (Port1 and Port2) of the coplanar line of the band-stop filter in FIGS. 16A and 16B. As seen in FIG. 16D, good characteristics are obtained in both the passband characteristic and stop-band characteristic. That is, as seen in FIGS. 16C and 16D, the characteristics of S11 and S22, and S21 and S12 are good in both the passband characteristic and stop-band characteristic, and the same characteristics are obtained if any one of Port 1 and Port 2 is on a power input side. It is therefore possible to use the band-stop filter according to this embodiment as, for example, a band-stop filter connected to a transmission/reception antenna.

In this embodiment, an example has been described in which the band-stop filter is formed in the electronic circuit substrate. However, the band-stop filter may be formed in a transmission line other than the electronic circuit substrate. As described above, the band-stop filter according to this embodiment can be formed by connecting the resonance conductors to the transmission line, and thus is also applicable to, for example, a transmission line, a coaxial line, a parallel line, or the like inside a semiconductor.

In this embodiment, the arrangement of the band-stop filter which stops the propagation of the electromagnetic waves in two frequency bands of the 4.9-GHz band and the 7.4-GHz band has been described. However, a filter which stops the propagation of electromagnetic waves in more than two frequency bands can also be formed in the same manner. For example, a case will be examined in which a band-stop filter which stops the propagation of electromagnetic waves in five frequency bands is formed. In this case, the structure which stops the propagation of the electromagnetic waves in five frequency bands as in FIG. 13A is connected to connection point 1 described above, and the structures which stop five frequency bands, respectively, as in FIGS. 14A and 15A are arranged away from connection point 1 by a predetermined distance each. This makes it possible to form the small band-stop filter as described above.

In this embodiment, to the transmission line, two resonance conductors which stop the propagation of the electromagnetic wave in the 4.9-GHz band are connected, and two resonance conductors which stop the propagation of the electromagnetic wave in the 7.4-GHz band are connected. That is, two resonance conductors resonating in each frequency band are connected to a transmission line. However, more than two resonance conductors may be connected. This also makes it possible to obtain a better passband characteristic and stop-band characteristic. For example, if three resonance conductors resonating in each frequency band are connected to a transmission line, it is possible to connect a resonance conductor resonating in the 4.9-GHz band at a position farther away from connection point 2 by λ3/4 and connect a resonance conductor resonating in the 7.4-GHz band at a position farther away from connection point 3 by λ4/4.

In the embodiment described above, the number of resonance conductors which stop the propagation of the electromagnetic wave in the 4.9-GHz band and resonance conductors which stop the propagation of the electromagnetic wave in the 7.4-GHz band is two for each to a transmission line. However, they may not be equal in number. For example, two resonance conductors which stop the propagation of the electromagnetic wave in the 4.9-GHz band may be connected, and one resonance conductor which stops the propagation of the electromagnetic wave in the 7.4-GHz band may be connected. For example, while a plurality of resonance conductors in a stop band (4.9-GHz band) close to the 2.4-GHz band are connected, only one resonance conductor in a stop band (7.4-GHz band) away from the 2.4-GHz band is connected. This makes it possible to reduce the influence on the pass band (2.4-GHz band) due to a portion contributing to the stop band (4.9-GHz band) close to the pass band and to seek the downsizing of a portion contributing to the stop band (7.4-GHz band) away from the pass band.

In this embodiment, the series resonance circuit of FIG. 12B is implemented by connecting, to the transmission line, the conductor pattern having the open end of the predetermined length. However, the arrangement in which the series resonance circuit is implemented is not limited to this. The series resonance circuit may be implemented by, for example, connecting or coupling a conductor pattern having the length of λ/2 to the transmission line.

Another method of implementing the band-stop filter will be described here. The equivalent circuit of the band-stop filter is as shown in FIG. 12A. In contrast, it is possible to implement the same characteristic as in FIG. 12A by arranging parallel resonance circuits away from each other by the distance of λ/4 as in FIG. 17A. Note that λ denotes the wavelength (electrical length) of each parallel resonance circuit at a resonance frequency f3. These transmission lines of λ/4 are the above-described immittance inverters.

Figure 17A:
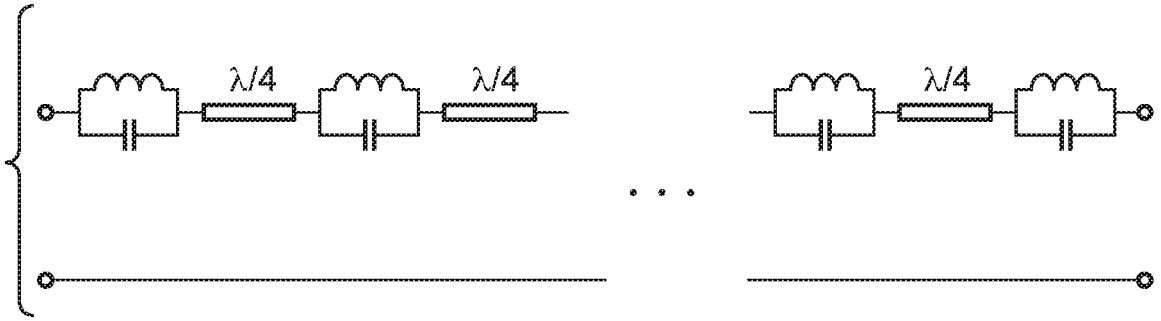
FIGS. 17A and 17B are equivalent circuit diagrams each showing another example of the arrangement of the band-stop filter.
Figure 17B:
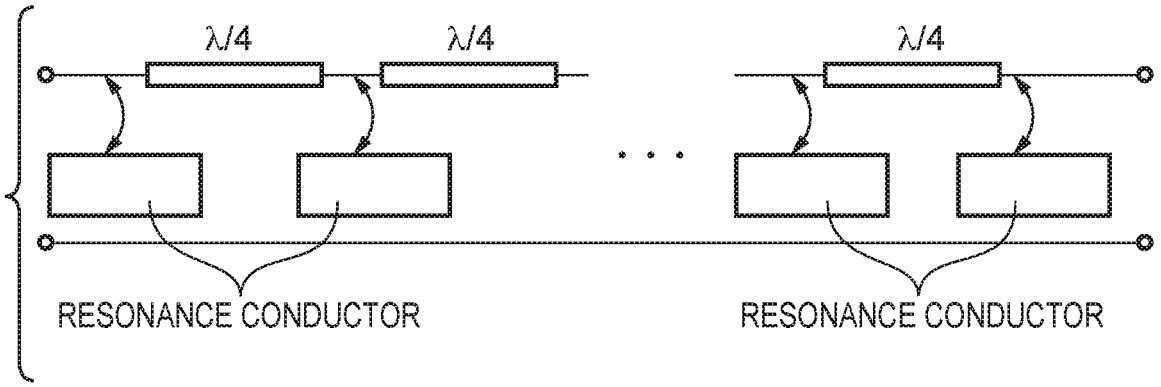

A method of implementing the parallel resonance circuits of FIG. 17A will now be described. The parallel resonance circuits of FIG. 17A can be implemented by, for example, coupling resonance conductors to a transmission line like a coplanar line as shown in FIG. 17B (each arrow in FIG. 17B indicates a coupled state). "Coupling" here represents electromagnetic coupling that includes electrostatic coupling (capacitive coupling), magnetic coupling (inductive coupling), or electromagnetic coupling in which both of these are mixed. Each resonance conductor here can be, for example, a conductor pattern which has an end portion on one side connected to ground, an end portion on the other side serving as an open end, and the length of $\lambda/4$ when $\lambda$ denotes the electrical length at a resonating frequency. Further, the resonance conductor at this time may be a conductor pattern which has the opened two end portions and the length of $\lambda/2$. Furthermore, the resonance conductor at this time may be a conductor pattern which has the two end portions short-circuited to ground and the length of $\lambda/2$. In a frequency band in which each resonance conductor resonates, its conductor pattern operates as a band-stop filter. Note that a method of reducing the total length of the immittance inverter portion described above and seeking the downsizing of each band-stop filter is also applicable to a case in which the band-stop filter is formed by coupling the resonance conductor to the coplanar line as in FIG. 17B. In this case, it is possible to change an outside Q by changing the distance between the transmission line and each resonance conductor.

Note that in this embodiment, the band-stop filter which stops two frequency bands of the 4.9-GHz band and the 7.4-GHz band has been described. It is also possible, however, to form a low-pass filter by, for example, bringing frequency bands to be stopped close to each other to form stop bands of a plurality of frequency bands.

The band-stop filter described in this embodiment can suppress noise or a harmonic component emitted from an antenna or the like by, for example, being mounted in a transmission line from a semiconductor chip which generates a signal for wireless communication to the antenna.

In each embodiment described above, a shape having the large number of winding portions such as a meander shape or a spiral shape is adopted as the shape of the stub. However, the shape is not limited to this, and the shape may have the smaller number of winding portions or may be any shape such as a straight-line shape or an arc shape. In each embodiment described above, the structure of the filter which stops noise or a harmonic propagating through the signal line has been described. However, the filter according to this embodiment is also applicable to, for example, a wiring such as a power supply line other than the signal line.

According to the present invention, it is possible to reduce the size of the filter structure having the plurality of stop bands.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A filter which suppresses propagation of an electromagnetic wave of a predetermined frequency band in one of a signal line and a power supply line, the filter comprising:

a first resonance conductor configured to resonate in a plurality of frequency bands connected or coupled to a first position of the one of the signal line and the power supply line; and a second resonance conductor configured to resonate with a first frequency band out of the plurality of frequency bands, and connected or coupled to a second position away from the first position by a length corresponding to an electrical length when an electromagnetic wave of the first frequency band propagates through the one of the signal line and the power supply line, wherein propagation of an electromagnetic wave of the plurality of frequency bands through the one of the signal line and the power supply line is suppressed.

2. The filter according to claim 1, further comprising a third resonance conductor configured to resonate with a second frequency band different from the first frequency band out of the plurality of frequency bands, and connected or coupled to a third position away from the first position by a length corresponding to an electrical length when an electromagnetic wave of the second frequency band propagates through the one of the signal line and the power supply line.

3. The filter according to claim 2, wherein the second position is a position away from the first position by a quarter of the electrical length when the electromagnetic wave of the first frequency band propagates through the one of the signal line and the power supply line, and the third position is a position away from the first position by a quarter of the electrical length when the electromagnetic wave of the second frequency band propagates through the one of the signal line and the power supply line.

4. The filter according to claim 2, wherein the third resonance conductor includes a linear portion formed in a layer, out of layers included in a substrate where the filter is formed, different from the layer of the one of the signal line and the power supply line.

5. The filter according to claim 2, wherein a frequency range of the first frequency band is higher than a frequency range of the second frequency band, and the second position is placed between the first position and the third position.

6. The filter according to claim 1, wherein each of the first resonance conductor and the second resonance conductor includes a linear portion formed in a layer, out of layers included in a substrate where the filter is formed, different from the layer of the one of the signal line and the power supply line.

7. The filter according to claim 6, wherein at least a part of the linear portion is formed to be sandwiched by ground conductors arranged in an upper layer and a lower layer of the layer where the linear portion is formed.

8. The filter according to claim 1, wherein the first resonance conductor includes a first conductor that is connected or coupled to the first position of the one of the signal line and the power supply line and a second conductor that is connected to a predetermined position of the first conductor.

* * * * *